US006533861B1

(12) United States Patent
Matsuda et al.

(10) Patent No.: US 6,533,861 B1
(45) Date of Patent: Mar. 18, 2003

(54) AUTOMATIC COATING APPARATUS

(75) Inventors: Hidetsugu Matsuda, Fujieda (JP); Osamu Yoshida, Tokyo (JP); Toshio Hosoda, Fujieda (JP); Yoshiyuki Abe, Kuwana (JP); Akihiko Arichi, Aichi (JP)

(73) Assignee: ABB K.K., Tokyo (JP)

( * ) Notice: Subject to any disclaimer, the term of this patent is extended or adjusted under 35 U.S.C. 154(b) by 121 days.

(21) Appl. No.: 09/786,353

(22) PCT Filed: Jul. 12, 2000

(86) PCT No.: PCT/JP00/04676

§ 371 (c)(1),
(2), (4) Date: Mar. 13, 2001

(87) PCT Pub. No.: WO01/03852

PCT Pub. Date: Jan. 18, 2001

(30) Foreign Application Priority Data

Jul. 13, 1999 (JP) ..... 11-199551

(51) Int. Cl.[7] ..... B05B 3/00

(52) U.S. Cl. ..... 118/323; 239/223; 239/305; 239/750

(58) Field of Search ..... 118/300, 307, 118/323, 629; 427/421; 239/173, 750, 305, 223, 233; 901/43; 211/124; 221/211

(56) References Cited

U.S. PATENT DOCUMENTS 4,532,148 A * 7/1985 Vecellio ..... 118/323
4,785,760 A 11/1988 Tholome
4,936,510 A 6/1990 Weinstein
4,944,459 A * 7/1990 Watanabe et al. ..... 239/305
6,439,480 B1 * 8/2002 Velde ..... 239/327

FOREIGN PATENT DOCUMENTS

| | | |
|---|---|---|
| EP | 850 693 | 7/1998 |
| JP | 60-122071 | 6/1985 |
| JP | 63-175662 | 7/1988 |
| JP | 1-168379 | 7/1989 |
| JP | 4-83549 | 3/1992 |
| JP | 8-229446 | 9/1996 |
| WO | WO 97/34707 | 9/1997 |

* cited by examiner

*Primary Examiner*—Richard Crispino
*Assistant Examiner*—Michelle A. Lazor
(74) *Attorney, Agent, or Firm*—Oblon, Spivak, McClelland, Maier & Neustadt, P.C.

(57) ABSTRACT

Mounted on a wrist portion (10) of a single coating robot (6) is a common main assembly body (11) to which a plural number of bell-shape heads (42, 81, 83) are replaceably connectible. Further, a head changer (61) is provided within a working area of the coating robot (6), the head changer (61) being provided with head gripping mechanisms (63) to hold a plural number of bell-shape heads (42, 81, 83) thereon. By the use of the coating robot (6), one of the bell-shape heads (42, 81, 83) on the head changer (61) is replaceably connected to the common main assembly body (11) to form a complete sprayer (55, 101). Accordingly, the coating robot (6) can perform various coating operations by selectively picking up a suitable bell-shape head (42, 81, 83) from the head changer (61) and connecting same to the common main assembly body (11).

13 Claims, 19 Drawing Sheets

AUTOMATIC COATING APPARATUS

TECHNICAL FIELD

This invention relates to an automatic coating apparatus which is suitable for use, for example, in coating objects such as vehicle bodies and the like.

BACKGROUND ART

Generally, coating objects like automotive vehicle bodies (hereinafter referred to simply as, "vehicle bodies" for brevity) are coated by an automatic coating apparatus which is installed within a coating booth. The automatic coating apparatus of this sort is largely constituted by a working mechanism which is put in action in relation with coating objects which are delivered to the coating booth by a conveyer, and a coater or sprayer unit which is mounted on the working mechanism and arranged to spray paint toward the delivered coating objects.

In this connection, as a working mechanism, it has been the general practice to employ a coating robot which is provided with a plural number of joints to carry out a coating operation on vehicle bodies according to contents of teaching, or a reciprocator which is arranged to reciprocate across a certain range in coating vehicle bodies. In order to follow the movement of vehicle bodies on a conveyer in the course of a coating operation, the working mechanism is usually mounted on a tracking mechanism and thereby moved along the conveyer.

Further, resorted to as a sprayer in most cases are bell-shape sprayers which are arranged to atomize paint mainly by means of a bell-shaped cup which is put in high speed rotation. There have been a diversity of bell-shape sprayers which differ from each other in diametrical size of the bell cup as well as in spurting direction and feed rate of shaping air which forms a spray pattern. A suitable bell-shape sprayer for a coating robot is selected depending upon various conditions such as the shape of an object to be coated, the type and color of paint to be used and coat finishing conditions. Therefore, for coating exterior panels of a vehicle body, for example, it is the general practice to use a bell-shape sprayer with a bell cup of a large diameter, which is suitable for coating broad surface areas and can produce satisfactory coatings in finish quality. On the other hand, for coating interior surfaces of vehicle bodies, a bell-shape sprayer with a bell cup of a small diameter is generally employed because it is more suited for spotwise coating operations.

In the case of a prior art automatic coating apparatus of this sort, different types of sprayers are employed as mentioned above, depending upon the shape of coating objects as well as upon the type and color of paint to be used. In use, each sprayer needs to be integrally mounted on a working mechanism like a coating robot, so that it has been necessary to provide a plural number of automatic coating apparatus along a vehicle body coating line to cope with different coating conditions, despite increases in equipments cost of the production line and in machine installation space, which necessitate to provide a coating booth of an extremely large size.

On the other hand, in order to solve these problems, various attempts have thus far been made to replace the sprayer each time when changing the paint color or conditions of a coating operation, as disclosed in Japanese Patent Laid-Open No. S60-122071 and H4-83549.

However, the prior art automatic coating apparatus, which are arranged to replace a sprayer as a whole by a different type, require to provide a plural number of diverse sprayers for each paint color, that is to say, to provide a vast number of sprayers. In addition, the prior art automatic coating apparatus has a drawback that a great deal of labor and time is required in replacing the entire sprayer each time.

Further, in this regard, there have been known in the art cartridge-type coating apparatus which are arranged to mount a sprayer fixedly on a coating robot, while setting a paint cartridge of a selected color replaceably on the sprayer in order to obviate the troublesome job of replacing the entire sprayer (e.g., as disclosed in Japanese Patent Laid-Open No. S63-175662 and H8-229446).

In the case of an automatic coating apparatus which is disclosed in the above-mentioned Japanese Patent Laid-Open No. S63-175662, a paint cartridge which is selected from an assortment of paint cartridges is replaceably loaded on a coating machine before starting a coating operation. At the time of cartridge replacement, by way of a hose which is connected to the sprayer, a wash fluid is supplied to wash away a previous color which has deposited on the sprayer.

On the other hand, an automatic coating apparatus which is disclosed in the other Japanese Patent Laid-Open No. H8-229446 is provided with a plural number of paint cartridges which are replaceably set on a bell-shape sprayer.

However, in the case of these prior art automatic coating apparatus, it is necessary to provide a hose along a robot arm to supply therethrough a wash fluid for washing the sprayer, despite the difficulties of routing the hose to and along the robot arm in a tidy way. In addition, the wash fluid supply hose which droops down between the robot arm and the sprayer may cause a flaw or damage to a coating object by contacting the hose during operation, or may suffer from damages or frictional wear by contacting other component parts of the apparatus.

Furthermore, in the case of a bell-shape sprayer as disclosed in Japanese Patent Laid-Open No. H8-229446, the sprayer with a bell-shape cup which is fixedly mounted on a coating robot in a fixed state requires a long washing time for cleaning the bell cup, and suffers from low productivity because a coating operation is interrupted for a long time while the bell cup is being washed.

DISCLOSURE OF THE INVENTION

In view of the above-described problems with the prior art, it is an object of the present invention to provide an automatic coating apparatus which is arranged to attach a diversity of bell-shape heads replaceably to a common assembly body which is mounted on a single working mechanism, thereby permitting considerable reductions in cost and apparatus installation space.

It is another object of the present invention to provide an automatic coating apparatus which permits to replace bell-shape heads in a facilitated manner and as a result to enhance the productivity of the apparatus.

It is still another object of the present invention to provide an automatic coating apparatus which permits to carry out and continue a coating operation by the use of one bell-shape head while washing another bell-shape head which was used in a previous coating operation, thus ensuring improved productivity of the apparatus.

It is a further object of the present invention to provide an automatic coating apparatus which can facilitate washing operations on bell-shape heads to a significant degree particularly in case the bell-shape heads are of a cartridge-type sprayer which is arranged to be replaceably loaded with a plural number of paint cartridges of different colors.

In order to solve the above-mentioned problems, according to the present invention, three is provided an automatic coating apparatus, which comprises: a working mechanism to be put in predetermined coating actions relative to a coating object; a common main assembly body fixedly mounted on the working mechanism to serve as a main assembly body for a number of sprayers; a number of bell-shape heads each displaceably connectable to the common main assembly body to form a bell-shape sprayers and adapted to spray supplied paint in a finely atomized form by means of a bell-shaped cup rotating at high speed; and a head changer provided within a working area of the working mechanism and adapted to hold a grip on and off the bell-shape heads at the time of replacing a bell-shape head on the common main assembly body.

With the arrangements just described, the head changer is located within a working area of the working mechanism, so that, at the time of replacing the bell-shape head which is replaceably attached to the common main assembly body, the bell-shape head can be automatically replaced by moving same to a predetermined head replacing position on the head changer through the working mechanism.

In a case where a bell-shape head is connected to the common main assembly body to form a bell-shape sprayer, the resulting bell-shape sprayer is moved by the working mechanism while spraying supplied paint from a bell cup toward a coating object.

In addition, since the bell-shape head is detachably connected to the common main assembly body, it can be replaced by other bell-shape heads of different spray patterns, depending upon the nature of coating surfaces of coating objects.

According to the present invention, the head changer is comprised of at least a couple of head gripper mechanisms, one for gripping a bell-shape head which has been transferred to a predetermined head replacing position by the working mechanism, and the other one for holding another bell-shape head in a waiting position in preparation for connection to the common main assembly body.

With the arrangements just described, upon completing a coating operation by one bell-shape head, the used bell-shape head is transferred to one of the gripping mechanisms by means of the working mechanism and detached from the common main assembly body and instead gripped on one gripping mechanism. In the next place, the common main assembly body is moved toward another bell-shape head waiting by on the other gripping mechanism by the working mechanism and connected with the new head to continue a coating operation.

According to the present invention, the head changer is comprised of head gripping mechanisms each adapted to hold a grip on and off a bell-shape head, and head washing mechanisms each adapted to wash a bell-shape head which is gripped on one of the head gripping mechanisms.

With the arrangements just described, as soon as a used bell-shape head is gripped on one gripping mechanism of the head changer, the bell-shape head including its bell cup can be cleaned by the use of a washing mechanism.

According to the present invention, the head changer is comprised of at least a couple of head gripper mechanisms, one for gripping a used bell-shape head which has been transferred to a predetermined replacing position by the working mechanism and the other one for holding another washed bell-shape head in a waiting position in preparation for connection to the common main assembly body, and at least a couple of head washing mechanisms each adapted to wash a bell-shape head which is gripped on one of the head gripping mechanisms.

With the arrangements just described, upon finishing a coating operation, a used bell-shape head is transferred to a predetermined head replacing position by the working mechanism, and gripped on one of the gripping mechanisms of the head changer. Then, another bell-shape head waiting by on the other gripping mechanism is picked up and connected to the common main assembly body by the working mechanism to continue the coating operation. In the meantime, the used bell-shape head which is gripped on one gripping mechanism, is washed by one washing mechanism concurrently with the coating operation by the other bell-shape head.

According to the present invention, the head changer is comprised of head gripping mechanisms adapted to hold a grip on and off a bell-shape head, washing mechanisms adapted to wash a bell-shape head gripped on one of the gripping mechanism, and a bearing air supply mechanism adapted to supply air to air bearing of an air motor of a bell-shape head which is gripped on one of the head gripping mechanisms.

With the arrangements just described, when a bell-shape head is gripped on one gripping mechanism of the head changer, bearing air is supplied to air bearing of an air motor of the gripped head. Accordingly, even when the bell-shape head is disconnected to the common main assembly body, the rotational shaft of the air motor is hydrostatically supported by the air bearing, thereby preventing abrasive wear or damages which would otherwise occur to the air motor.

According to the present invention, each one of the bell-shape sprayers is of a cartridge-type adapted to be replaceably loaded with paint cartridges of various colors, each one of the paint cartridge comprising a container filled with paint and a feed tube extending axially forward from the container.

With the arrangements just described, paint cartridges of various colors can be replaceably loaded into the common main assembly body of the bell-shape sprayer. In this case, the cartridge-type sprayer can feed paint of different colors through feed tubes of the respective paint cartridges.

According to the present invention, the common main assembly body comprises a cartridge loading cavity for receiving the paint cartridge and an axial feed tube passage hole to receive the feed tube, and each one of the bell-shape heads is internally provided with an axial feed tube passage hole to receive said feed tube.

With the arrangements just described, when one of the paint cartridges of different colors is selectively fitted into the common main assembly body, paint of a selected color can be fed to the bell-shape head through the feed tube which is passed into the feed tube passage holes in the common main assembly body and the bell-shape head.

According to the present invention, each one of the bell-shape heads is internally provided with an axial feed tube passage hole to receive the feed tube of the paint cartridge therein, and the head changer is provided with head gripping mechanisms for gripping the bell-shape heads along with washing mechanisms for washing the bell-shape heads while being gripped on the head gripping mechanisms, the washing mechanisms each being provided with a wash fluid supply tube to be inserted into the feed tube passage hole in the bell-shape head for spurting a wash fluid thereinto.

With the arrangements just described, when a bell-shape head is gripped on one gripping mechanism of the head changer after a coating operation, the wash fluid supply tube of a washing mechanism is passed into the feed tube passage hole of the bell-shape head, and a wash fluid is spurted out from the wash fluid supply tube to wash away deposited paint from the bell-shape head.

According to the present invention, the bell-shape heads are each internally provided with an axial feed tube passage hole to receive the feed tube of the paint cartridge, and the head changer is provided with head gripping mechanisms for gripping the bell-shape heads, washing mechanisms for washing the bell-shape heads while being gripped on the head gripping mechanisms, and bearing air supply mechanisms for supplying bearing air to an air bearing of an air motor in the bell-shape heads while being gripped on the gripping mechanisms, the washing mechanisms each being; provided with a wash fluid supply tube to be inserted into the feed tube passage hole in the bell-shape head for spurting a wash fluid thereinto, and a turbine air supply passage for supplying turbine air to the air motor of a bell-shape head being washed, thereby keeping the bell cup in rotation during a washing operation.

With the arrangements just described, when a bell-shape head is gripped on one gripping mechanism of the head changer after a coating operation, bearing air is supplied to the air bearing of the air motor from the bearing air supply mechanism to hydrostatically support the rotational shaft of the air motor. Further, the wash fluid supply tube of a washing mechanism is passed into the feed tube passage hole in the bell-shape head, and the turbine air supply passage is connected to the air motor of the bell-shape head. Then, through the turbine air supply passage, turbine air is supplied to the air motor of the bell-shape head, so that a bell cup on the bell-shape head is kept in rotation while a wash fluid is spurted out from the wash fluid supply tube to wash away deposited paint from the head including the bell cup.

According to the present invention, the common main assembly body is provided with a head connecting portion to which one of the bell-shape heads is disconnectibly connected, and an air suction passage in communication with a vacuum space formed between the head connecting portion and a connected bell-shape head, sucking out air from the vacuum space through the air suction passage to hold the bell-shape head fixedly to the common main assembly with suction grip.

With the arrangements just described, upon connecting a bell-shape head to the head connecting portion of the common main assembly body, air is sucked out through the air suction passage from a vacuum space which is formed between the head connecting portion and the bell-shape head, thereby to pull and hold the bell-shape head against the common main assembly body fixedly and stably by a suction grip. On the other hand, at the time of disconnecting the bell-shape head from the common main assembly body, air is supplied to the vacuum space to cancel the suction grip.

According to the present invention, the common main assembly body has a feed tube axially projected on the front side thereof, while the bell-shape heads are each internally provided with an axial feed tube passage hole to receive the feed tube.

With the arrangements just described, paint is of a desired color can be supplied through a color changing valve device or the like, and the supplied paint spurted out from the feed tube of the common main assembly body and sprayed by the bell-shape head.

According to the present invention, there is also provided an automatic coating apparatus, which comprises: a working mechanism to be put in predetermined coating actions relative to a coating object; a common main assembly body fixedly mounted on the working mechanism to serve as a common main assembly body for a number of bell-shape sprayer; a number of bell-shape heads each displaceably connectible to the common main assembly body to form bell-shape sprayers and adapted to spray supplied paint in a finely atomized form by means of a bell-shaped cup rotating at high speed; a number of paint cartridges of different colors, each having a container filled with a specific paint color, a feed tube axially extended out on the front side of the container for insertion into the common main assembly body and one of the bell-shape heads; and a head changer provided within a working area of the working mechanism and adapted to hold a grip on and off the bell-shape heads at the time of replacing a bell-shape head on the common main assembly body; and said bell-shape sprayers are formed cartridge-type bell-shape sprayers which are replacabley connected a number of paint cartridge of different colors to said common main assembly body.

In a preferred form according to the present invention, the working mechanism is a coating robot or a coating reciprocator provided in a coating booth, and the common main assembly body is mounted on a distal end portion of the coating robot or reciprocator.

With the arrangements just described, by moving the coating robot or coating reciprocator in predetermined actions, the bell-shape head which is connected to the common main assembly body, on a fore distal end of an arm of the robot or reciprocator, is moved along coating surfaces of a coating object to spray paint thereon.

BEST MODE FOR CARRYING OUT THE INVENTION

Figure 1:
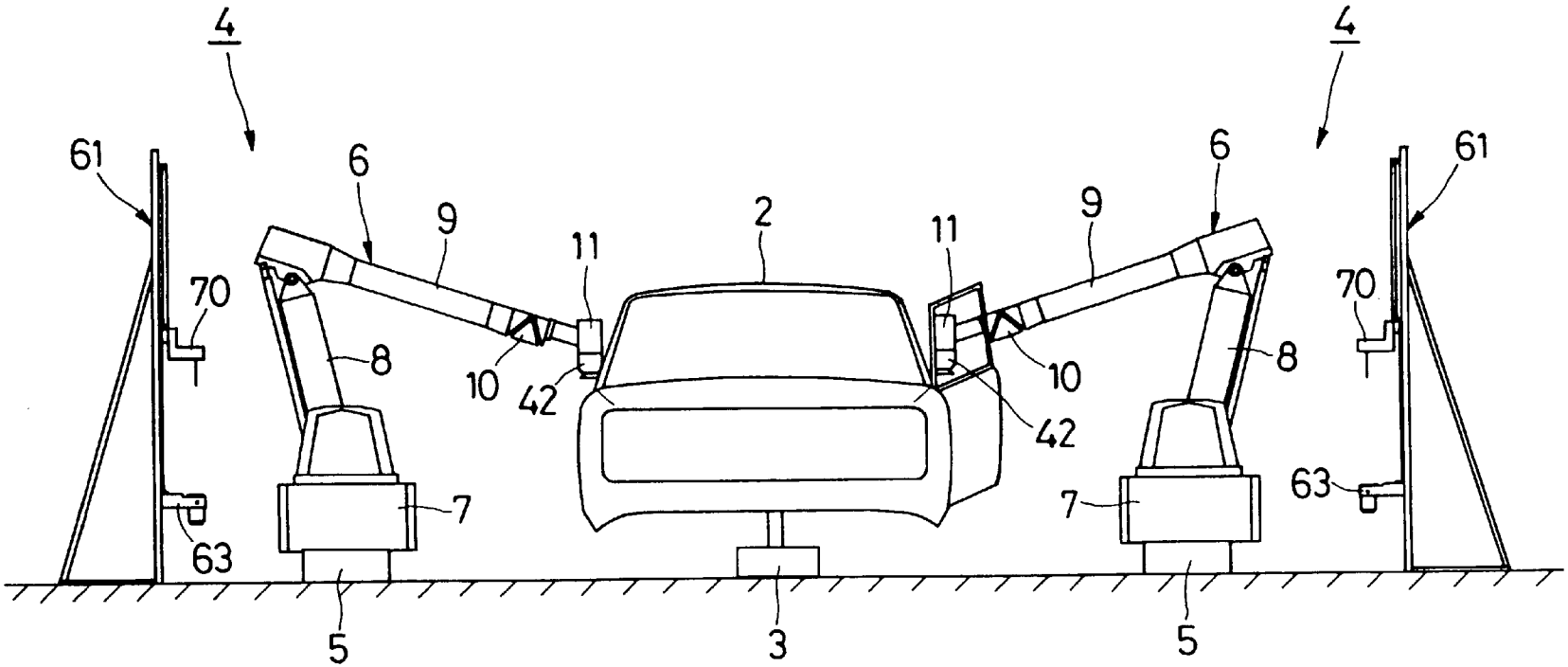
FIG. 1 is a front view of an automatic coating apparatus according to a first embodiment of the present invention, showing the automatic coating apparatus along with a vehicle body and a conveyer.
Figure 2:
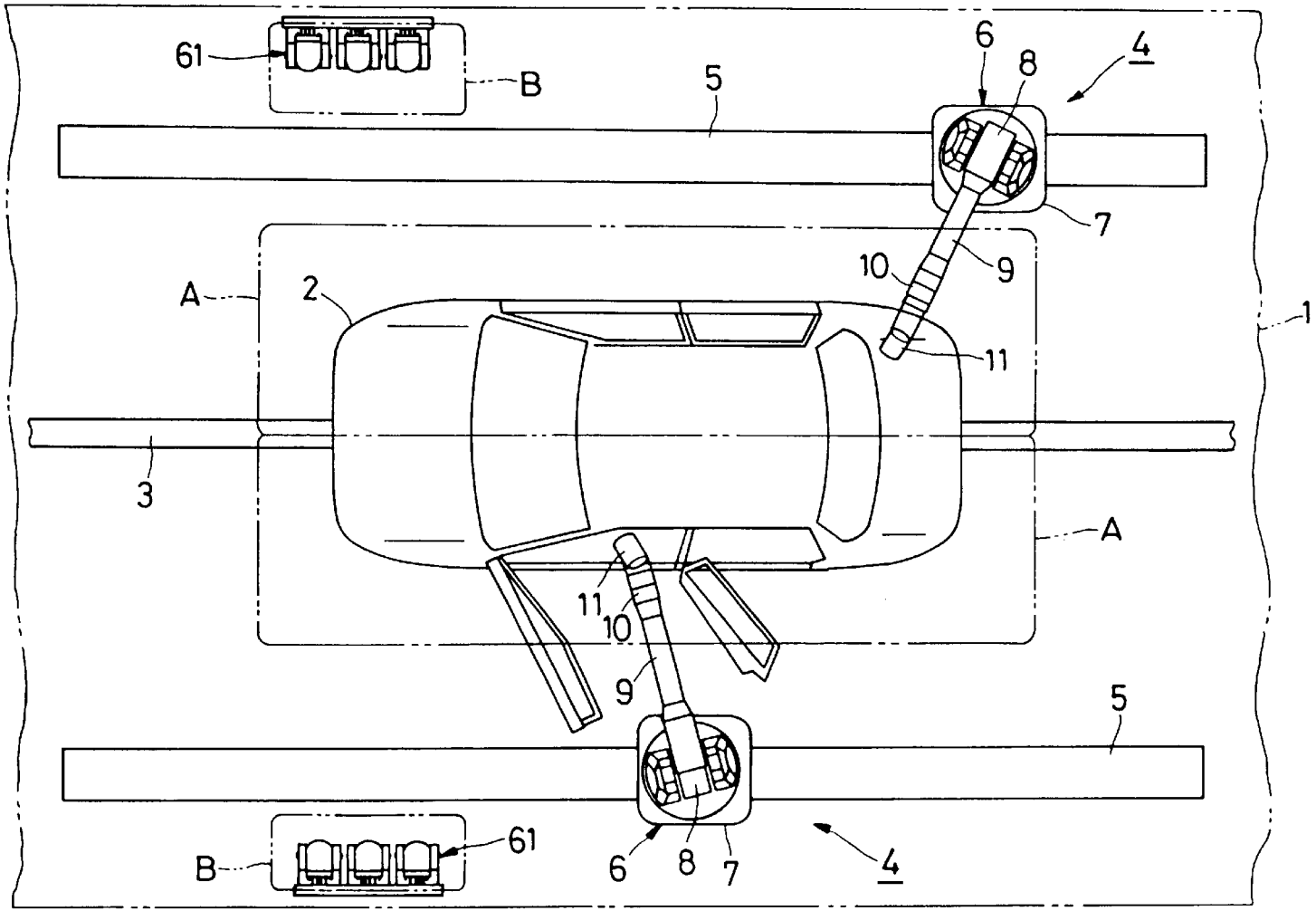
FIG. 2 is a plan view of the automatic coating apparatus which is installed within a coating booth.

Hereafter, the present invention is described more particularly with reference to the accompanying drawings which show by way of example vehicle body coating operations by automatic coating apparatus according to the present invention.

Referring first to FIGS. 1 through 20, there is shown a first embodiment of the present invention, having a feature in that it permits to replaceably mount on the apparatus a bell-shape head chosen from three different types of bell-shape heads.

Indicated at 1 is a coating booth which is provided for coating automotive vehicle bodies 2 as objects to be coated (indicated by two-dot chain line in FIG. 2), which are delivered one after another by a conveyer 3 which is provided in the coating booth 1. Provided alongside and on each side of the conveyer 3 is an automatic coating apparatus 4 as will be described in greater detail later.

Designated at 4 are the automatic coating apparatus which are located alongside and on the opposite sides of the conveyer 3. Each automatic coating apparatus 4 is largely constituted by a coating robot 6, a common main assembly body 11, a bell-shape head 42, 81 or 83, and a head changer 61.

Denoted at 5 are two track rails which are provided at a predetermined distance from and in parallel relation with the opposite right and left sides of the conveyer 3. The track rail 5 constitutes a tracking mechanism, as part of a working mechanism, providing a track to let a coating robot 6, which will be described hereinlater, move parallel with the conveyer 3, following movements of a vehicle body 2 which is transferred by the conveyer 3.

Indicated at 6 are coating robots which are provided on the track rails 5 to serve as a working mechanism, respectively. According to contents of teaching and through a common main assembly body 11 which is provided at a fore distal end, the coating robot 6 is operative to move a bell-shape head 42 along with the vehicle body 2 on the conveyer while coating the vehicle body 2. In this instance, as shown in FIG. 1, the coating robot 6 is largely constituted by a base 7 which is mounted on the track rail 5 and movable in the transfer direction of the conveyer 3, a vertical arm 8 which is rotatably and pivotally supported on the base 7, a horizontal arm 9 which is pivotally supported on an upper end of the vertical arm 8, and a wrist portion 10 which is provided at a fore distal end of the horizontal arm 9. Further, the coating robot 6 is operative to move the bell-shape head to and from a coating zone A for coating a vehicle body 2 and a head replacing zone B for replacing a bell-shape head 42, 81 or 83 which will be described hereinafter.

Figure 3:
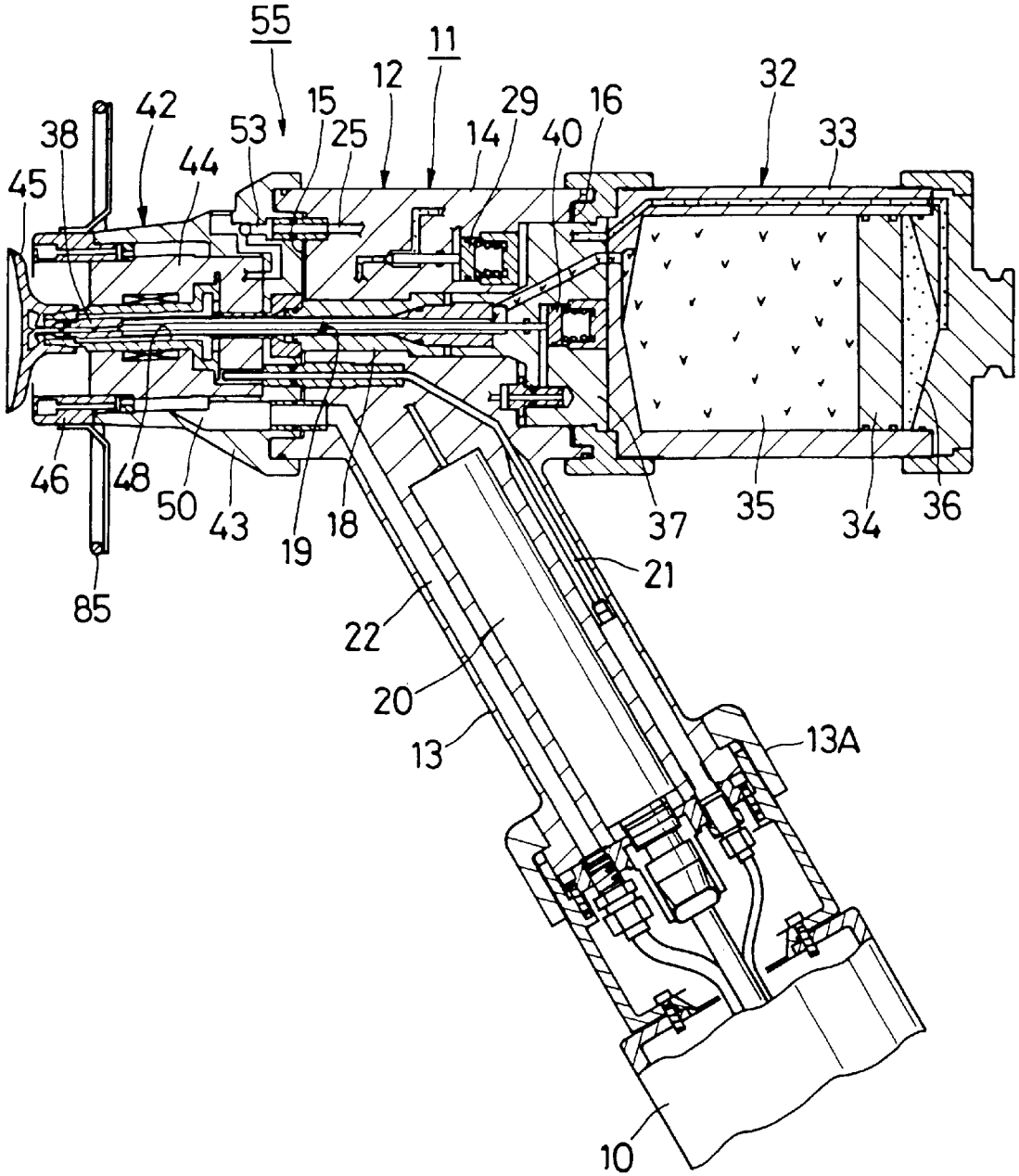
FIG. 3 is a vertical sectional view, taken through a common main assembly body, a paint cartridge and a bell-shape head of the apparatus.
Figure 4:
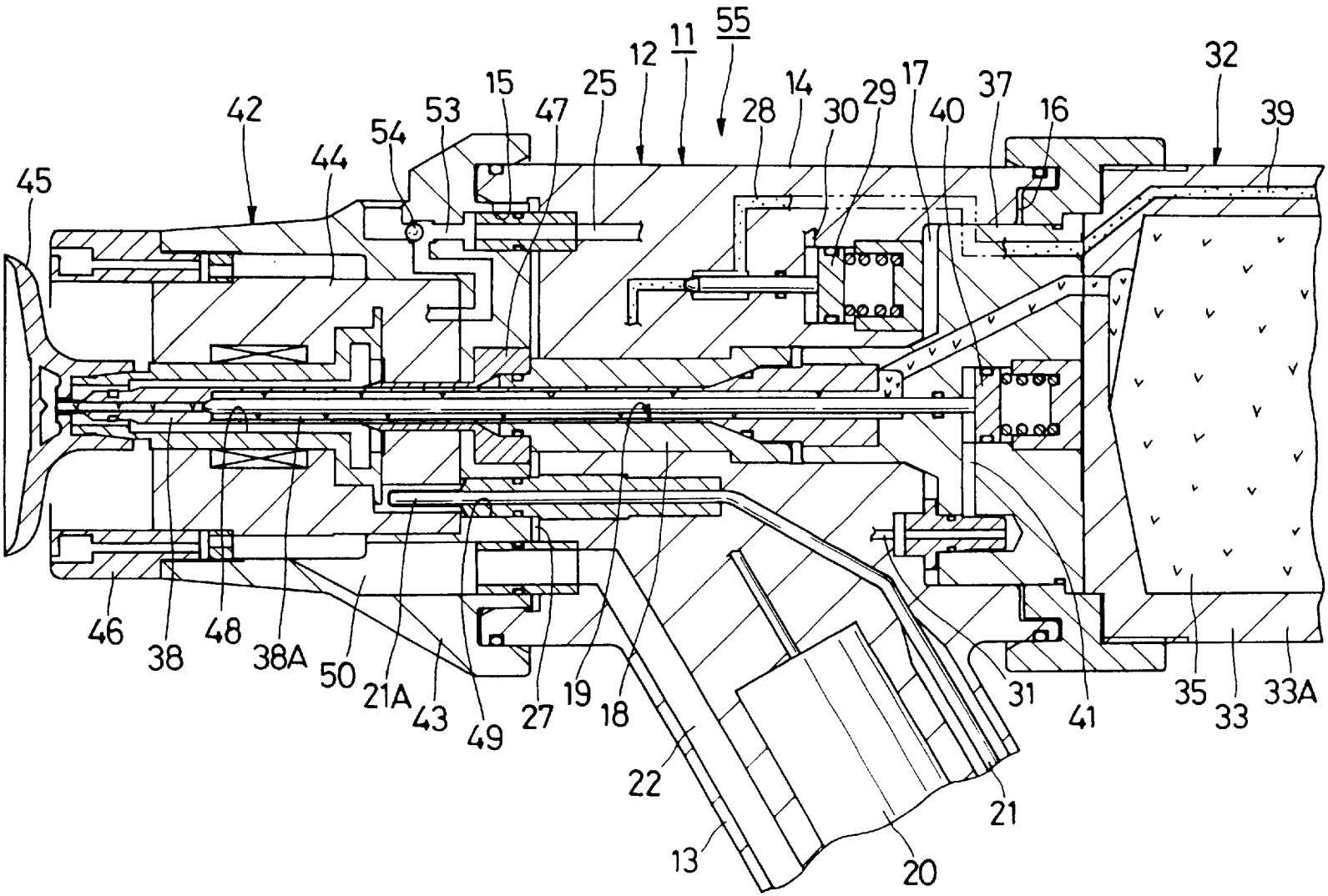
FIG. 4 is an enlarged vertical sectional view through the common main assembly body, paint cartridge and bell-shape head of FIG. 3, with a repulsive electrode omitted therefrom.

Indicated at 11 is a common main assembly body which is provided on the coating robot 6. As shown in FIGS. 3 and 4, the common main assembly body 11 is largely constituted by a housing 12, a head connecting portion 15, a cartridge loading cavity 16 and a feed tube passage hole 19. In this instance, the common main assembly body 11 constitutes a common base body in setting up a number of cartridge-type bell-shape sprayers 55 of different properties.

Indicated at 12 is the housing which forms an outer shell of the common main assembly body 11. The housing 12 is mounted on a fore distal end of the wrist portion 10. More specifically, the housing 12 is constituted by a neck portion 13 which is attached to the wrist portion 10 at the fore distal end of the horizontal arm 9 through a cylindrical clamp portion 13A, and a coupler portion 14 which is formed integrally at a fore distal end of the neck portion 13.

Figure 5:
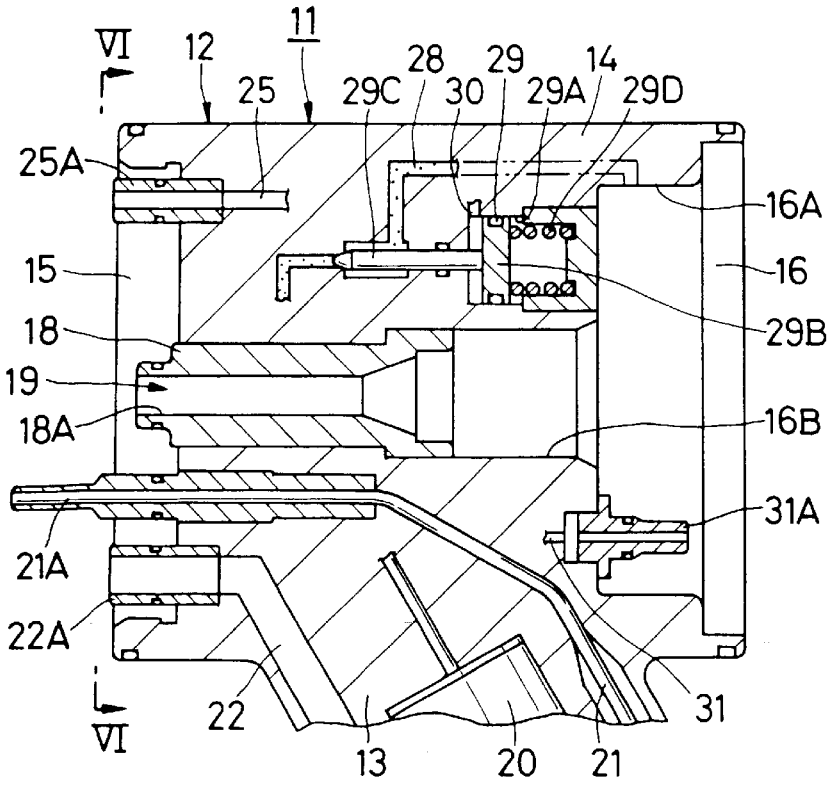
FIG. 5 is a fragmentary vertical sectional view on an enlarged scale of the common main assembly body.
Figure 6:
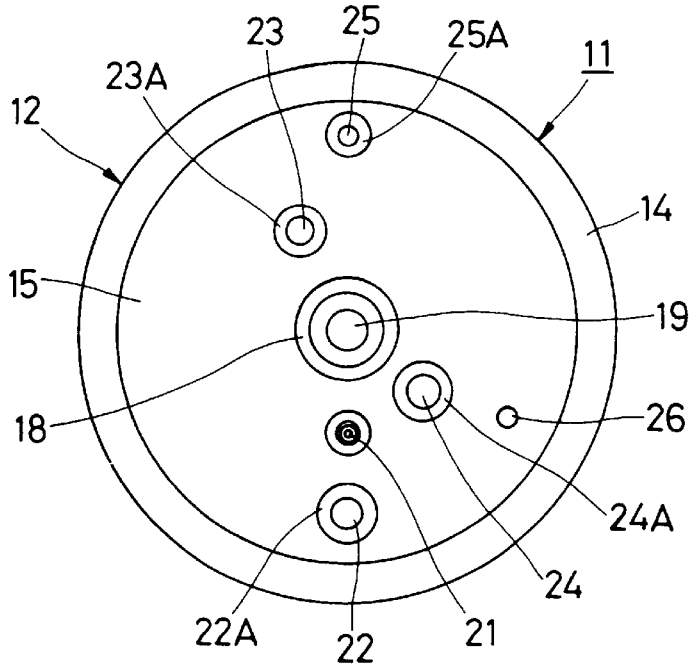
FIG. 6 is a left-hand side view of the common main assembly body, taken in the direction of arrows VI—VI of FIG. 5.

Denoted at 15 is a head connecting portion which is provided at the front end of the coupler portion 14. To this head connecting portion 15, the bell-shape head 42 and so forth are replaceably connected in the manner as will be described hereinafter. As shown in FIG. 5, the head connecting portion 15 is formed in a hollow cylindrical shape. Upon fitting a rear end portion of the bell-shape head 42 into the head connecting porting 15, a vacuum space 27 is formed therebetween thereby to hold the bell-shape head 42 fixedly to the head connecting portion 15 with suction grip.

Further, designated at 16 is the cartridge loading cavity which is formed into the rear end of the coupler portion 14. This cartridge loading cavity 16 replaceably receives therein a paint cartridge 32 which will be described hereinafter. As shown in FIG. 5, the cartridge loading cavity 16 is provided with a stepped large diameter bore portion 16A to be brought into fitting engagement with a container 33 of a paint cartridge 32 and a cartridge casing block 37, and a small diameter bore portion 16B to be brought into fitting engagement with a support cylinder 37A of the cartridge casing block 37. When a container 33 of a paint cartridge 32 is fitted into the cartridge loading cavity 16, air is sucked out through an air suction passage (not shown) from a vacuum space 17 which is formed on the inner side of the cartridge container 33, thereby holding the paint cartridge 32 fixedly in the loaded position with suction grip substantially through the same mechanism as the suction grip on the head connecting portion 15.

Indicated at 18 is a tube guide on the side of the common main assembly body, to be fitted in coaxial relation with the cartridge loading cavity 16. This tube guide 18 is formed in the shape of a stepped tube by a conductive material, and, as shown in FIG. 5, internally provided with a hollow passage 18A which forms part of a feed tube passage hole 19.

Indicated at 19 is the feed tube passage hole on the side of the main assembly unit which is composed of the small diameter bore portion 16B of the cartridge loading cavity 16 and the hollow passage 18A of the tube guide 18. This feed tube passage hole 19 is formed in the shape of a stepped bore which extends through and between the head connecting portion 15 and the cartridge loading cavity 16 of the coupler portion 14. Further, the feed tube passage hole 19 is formed in coaxial relation with a feed tube passage hole 48 on the side of the head, which will be described after.

Denoted at 20 is a high voltage generator which is provided on the neck portion 13 of the housing 12. This high voltage generator 20 is constituted, for example, by a Cockcroft circuit and adapted to elevate a source voltage from a power supply (not shown), for example, to a high voltage level between −60 kv and −120 kv. The output side of the high voltage generator 20 is electrically connected, for example, to the tube guide 18 on the side of the main assembly body. Accordingly, paint which flows through the feed tube 38 is directly charged by a high voltage from the high voltage generator 20 through the tube guide 18. Further, the high voltage is also applied to the bell cup 45 from the feed tube 38 through a rotational shaft 44C of an air motor 44.

Indicated at 21 is an optical fiber cable which is provided on the housing 12 to extended between and through the neck portion 13 and the coupler portion 14 of the housing 12. A plug 21A which is provided at the fore distal end of the optical fiber cable 21 is projected on the front side of the head connector portion 15. When the bell-shape head 42 is attached to the head connecting portion 15 of the coupler portion 14, the plug 21A of the optical fiber cable 21 is received in a cable receptacle hole 49 and located in the proximity of an air turbine pin 44D of the air motor 44. Through the optical fiber cable 21, rotational speed of the air turbine 44D is detected by a rotational speed sensor (not shown) which is connected to the proximal end of the optical fiber cable 21.

Denoted at 22 is a shaping air passage on the side of the main assembly body which is provided in the housing 12 to supply shaping air to a shaping air ring 46 which will be described hereinafter. The shaping air passage 22 is provided with a joint tube portion 22A at its fore end to be connected to a shaping air passage 50 on the side of the head.

Indicated at 23 is a turbine air passage (FIG. 6) on the side of the main assembly body, which is provided in the housing 12. This turbine air passage 23 serves to supply driving air to the air turbine 44D of the air motor 44. Further, similarly to the above-mentioned joint tube 22A, the turbine air passage 23 is provided with a joint tube 23A to be connected to a turbine air passage 51 on the side of the head.

Indicated at 24 is a brake air passage on the side of the main assembly body, which is provided in the housing 12. This brake air passage 24 serves to supply brake air to the air turbine 44D of the air motor 44. Further, similarly to the joint tube 22A, the brake air passage 24 is also provided with a joint tube portion 24A to be connected to a brake air passage 52 on the side of the head.

Designated at 25 is a bearing air passage on the side of the main assembly body, which is also provided in the housing 12. This bearing air passage 25 serves to supply bearing air to an air bearing 44E of the air motor 44. Likewise, the bearing air passage 25 is provided with a joint tube portion 25A to be connected to a bearing air passage 53 on the side of the head.

Further, indicated at 26 is an air suction passage which is provided in the housing 12. Through this air suction passage 26, air is sucked out from a vacuum space 27 (FIG. 4) which is formed between the head connecting portion 15 of the housing 12 and the rear end of the bell-shape head 42 when the head 42 is attached to the connecting portion 15, thereby to hold the bell-shape head 42, 81 or 83 fixedly to the housing 12 with suction grip.

Denoted at 28 is a thinner passage on the side of the main assembly body, which is provided in the housing 12. When a paint cartridge 32 is set in the cartridge loading cavity 16 of the housing 12, the thinner passage 28 is connected to a thinner passage 39 which is provided on the side of the paint cartridge 32. The thinner passage 28 serves to supply thinner to the paint cartridge 32 for extrusion of paint therefrom.

Indicated at 29 is a thinner valve which is provided on a mount portion 14 of the housing 12. The thinner valve 29 functions to open and close the thinner passage 28 on the side of the main assembly body to turn on and off the supply of thinner to a thinner passage 39 on the side of the paint cartridge as a paint-extruding liquid. In this instance, the thinner valve 29 is largely constituted by a cylinder bore 29A which is formed in the mount portion 14, a piston 29B which is axially slidably fitted in the cylinder bore 29A, a valve member 29C which is axially extended forward from the piston 29B, and a valve spring 29D which is adapted to urge the valve member 29C in a closing direction through the piston 29B.

As soon as a paint cartridge 32 is unloaded out of the cartridge loading cavity 16, the valve member 29C of the thinner valve 29 is urged into a closed position, thereby closing the thinner passage 28 on the side of the main assembly body under the influence of the biasing force of the valve spring 29D to prevent outflow of thinner. On the other hand, when a paint cartridge 32 is set in the cartridge loading cavity 16, pilot air is supplied through a pilot air passage 30 to urge the valve member 29C of the thinner valve 29 into an open position, thereby bringing the above-mentioned thinner passage 28 into communication with the thinner passage 39 on the side of the paint cartridge to permit circulation of thinner toward the paint cartridge 32.

In this manner, the thinner valve 29 functions to control paint supply from a paint chamber 35 of the paint cartridge 32 to the feed tube 38 by bringing the thinner passage 28 into and out of communication with a thinner chamber 36 in the paint cartridge 32 to turn on and off the supply thereto of the paint-extruding thinner.

Indicated at 31 is a pilot air passage which is provided at the bottom of the cartridge loading cavity 16 on the side of the main assembly body. On the front side, the pilot air passage 31 is formed into a plug 31A and projected into the cartridge loading cavity 16. The plug 31A of the pilot air passage 31 is connected to a pilot air passage 41 on the side of the paint cartridge to supply pilot air to a paint valve 40 which will be described after.

Figure 7:
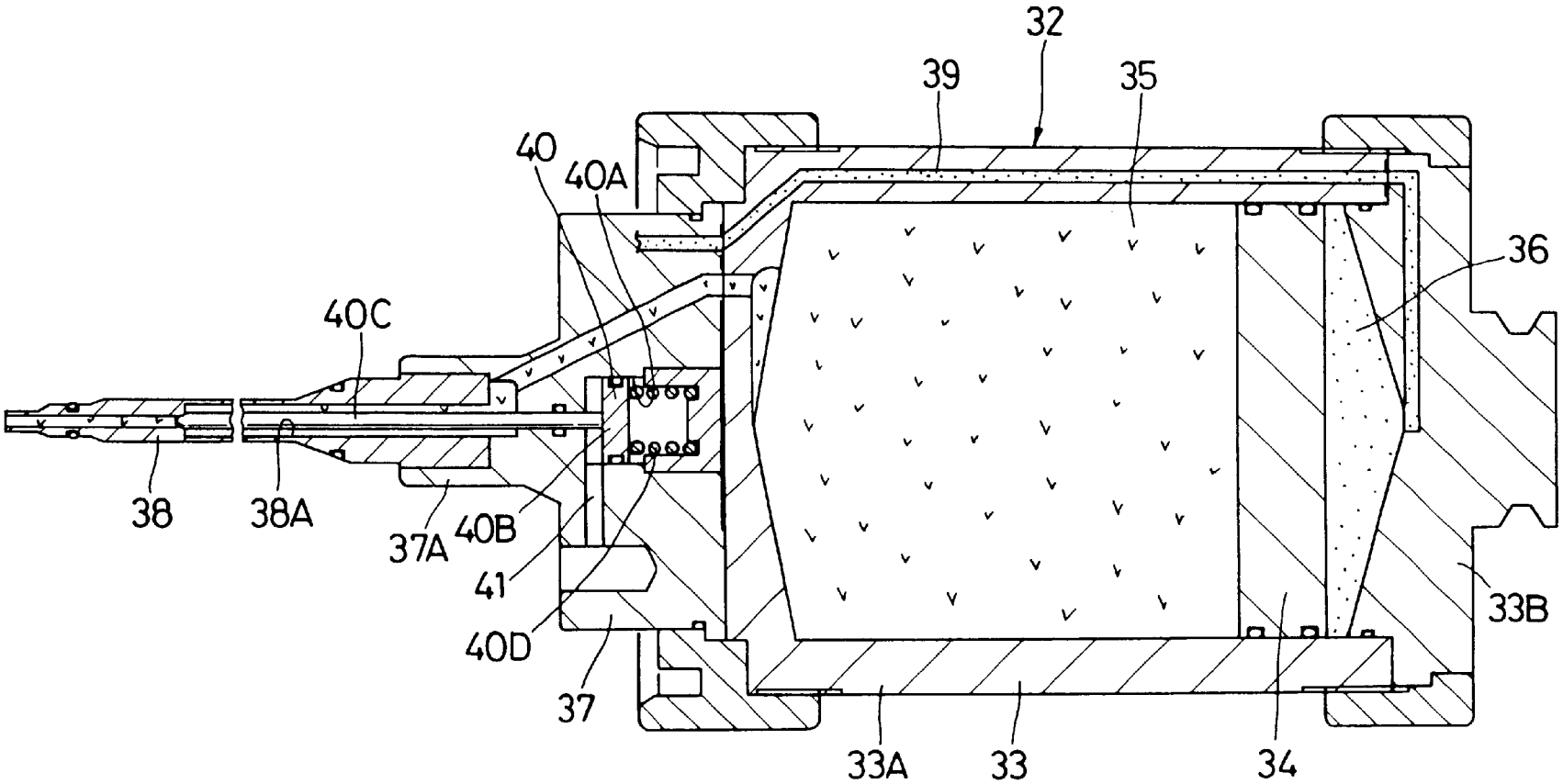
FIG. 7 is an enlarged vertical sectional view of the paint cartridge.

Denoted at 32 is a paint cartridge which is removably loaded in the common main assembly body 11. A plural number of similar paint cartridges 32 are provided for a number of different paint colors. As shown in FIG. 7, each paint cartridge 32 is largely constituted by a container 33 and a feed tube 38 as described below.

Indicated at 33 is the container which constitutes a main body of the paint cartridge 32. The container 33 is composed of a main container body 33A which is in the shape of a bottomed cylindrical casing and closed on the front side, and a lid 33B which is adapted to close the rear side of the main container body 33A.

Designated at 34 is a piston which is axially displaceably fitted in the container 33, thereby dividing the inner space of the container 33 into the fore-mentioned paint chamber 35 on the front side and the thinner chamber 36 on the rear side.

Indicated at 37 is a valve casing block which is attached to the front side of the main container body 33A of the container 33. Projected forward and centrally on the front side of the valve casing block 37 is a support tube 37A to be advanced into the feed tube passage hole 19 on the side of the main assembly body for supporting the feed tube 38.

Denoted at 38 is the feed tube which is provided on the front side of the valve casing block 37. This feed tube 38 is formed of a conducting material, with its base end portion securely fixed in the support tube 37A of the valve casing block 37 and its fore end extended axially forward and opened toward a bell cup 45 which will be described hereinafter. Further, formed internally of the feed tube 38 is an axial paint supply passage 38A which is in communication with the paint chamber 35 within the cartridge container 33. Further, when the paint cartridge 32 is loaded in the common main assembly body 11, the feed tube 38 is projected forward on the front side of the head connecting portion 15 through the feed tube passage hole 19 on the side of the main assembly body.

Indicated at 39 is the thinner passage which is provided in the container 33 of the side of the paint cartridge in communication with the thinner chamber 36. When the paint cartridge 32 is loaded into the common main assembly body 11, the thinner passage 39 is brought into communication with the thinner passage 28 on the side of the main assembly body. When the thinner valve 29 is opened, thinner is supplied from the thinner passage 39 to the thinner chamber 36 through the thinner passage 28 to push the piston 34 forward.

Further, indicated at 40 is a paint valve which is provided in the valve casing block 37. This paint valve 40 serves to open and communication with the paint supply passage 38A in the feed tube 38. In this instance, the paint valve 40 is largely constituted by a cylinder bore 40A which is formed in the valve casing block 37, a piston 40B which is axially slidably fitted in the cylinder bore 40A, a valve member 40C with its base end securely fixed to the piston 40B and its fore end extended forward through the feed tube 38 paint supply passage 38A substantially in coaxial relation therewith, and a valve spring 40D which is adapted to urge the valve member 40C in a closing direction through the piston 40B.

Normally, under the influence of the biasing action of the valve spring 40D, the valve member 40C of the paint valve 40 is held in a closed position to block the paint supply passage 38A of the feed tube 38. On the other hand, as soon as pilot air is supplied through the pilot air passages 31 and 41, the valve member 40C is opened through the piston 40B to permit circulation of paint through the paint supply passage 38A.

By opening and blocking communication with the paint supply passage 38A of the feed tube 38 through the valve member 40C in this manner, the paint valve 40 performs on-off control on the paint supply from the feed tube 38 to the bell-shape head 42 which will be described below.

Figure 8:
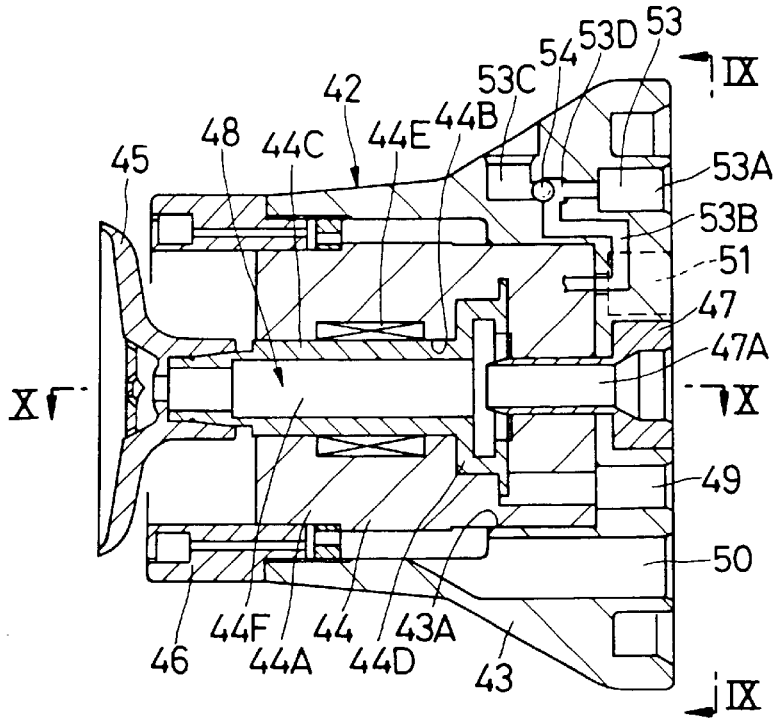
FIG. 8 is an enlarged vertical sectional view of the bell-shape head, with the repulsive electrode omitted therefrom.
Figure 9:
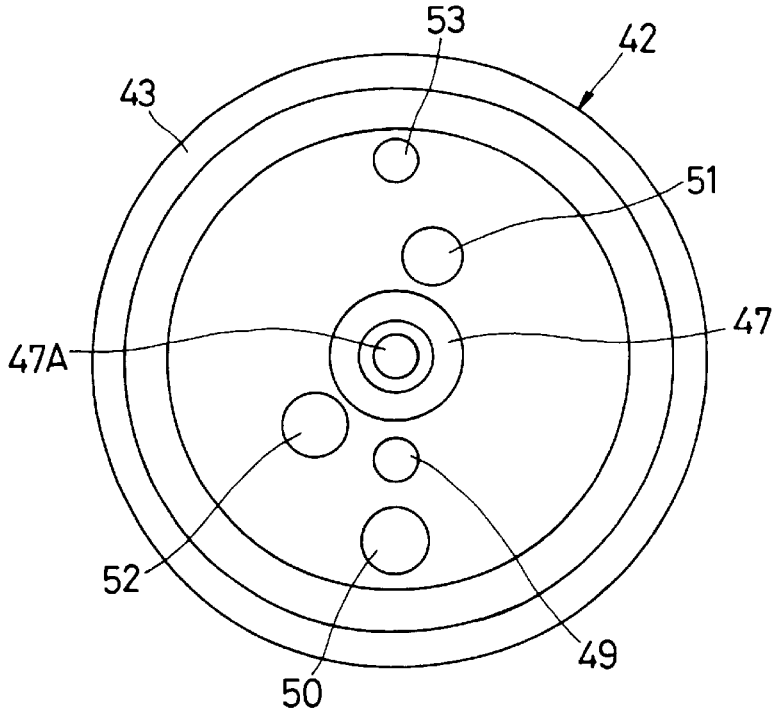
FIG. 9 is a right-hand side view of the bell-shape head, taken in the direction of arrows IX—IX of FIG. 8.
Figure 10:
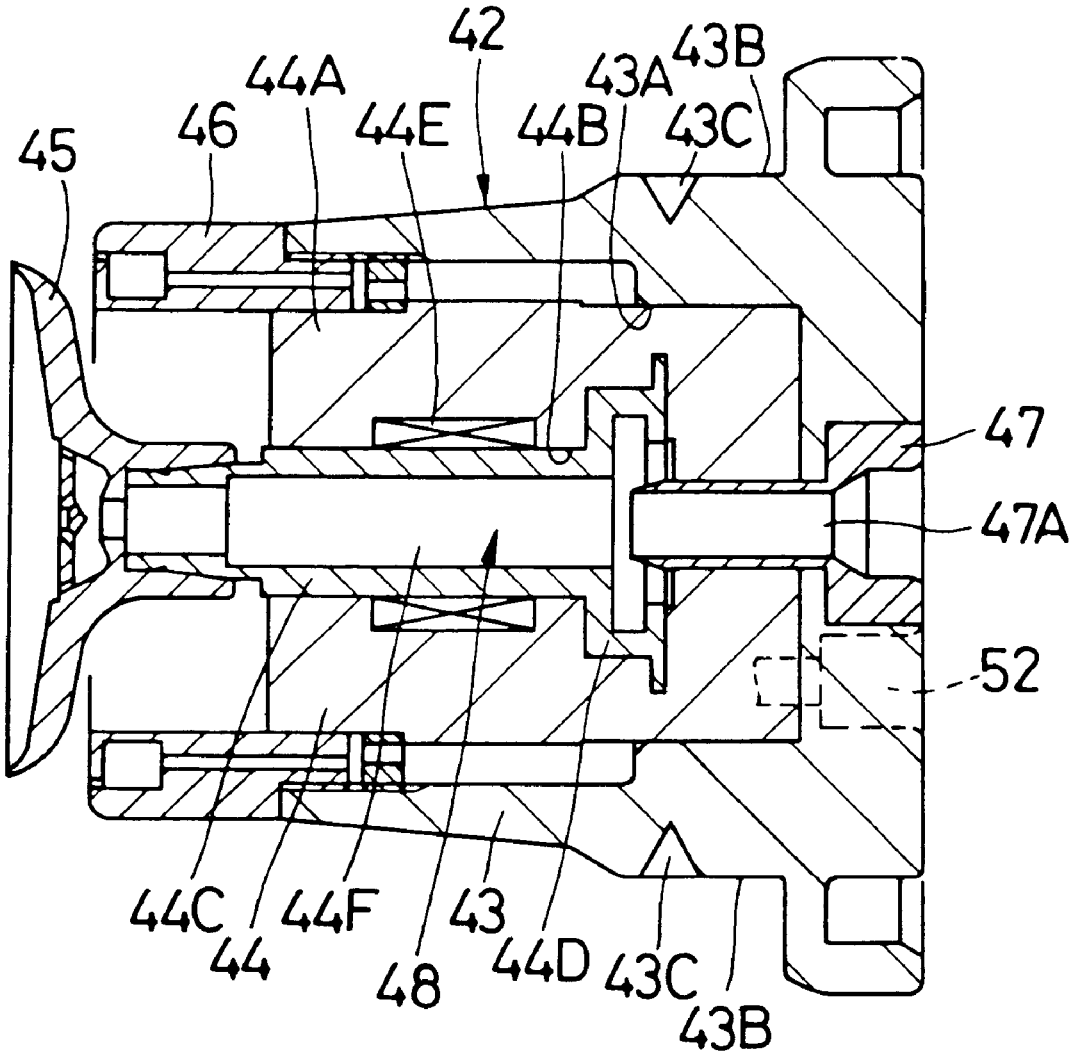
FIG. 10 is a vertical sectional view of the bell-shape head, taken in the direction of arrows X—X of FIG. 8.

Now, indicated at 42 is the bell-shape head which is detachably connected to the head connector portion 15 of the housing 12. In combination and in cooperation with the common main assembly body 11, the bell-shape head 42 constitutes a cartridge-type bell-shape sprayer 55. As shown in FIGS. 8 to 10, the bell-shape head 42 is largely constituted by a body 43, an air motor 44, a bell cup 45 and a shaping air ring 46, which will be described below.

Designated at 43 is the body which forms an outer shell of the bell-shape head 42. This body 43 is formed in a tubular shape having its circumferential surface gradually tapered in a forward direction and internally defining a motor receptacle cavity 43A. Further, as shown in FIG. 10, the body 43 is formed with a pair of grip surfaces 43B on its outer peripheral surfaces, in parallel relation with each other and in radially opposite positions. Furthermore, the body 43 is provided with a pair of radial conical grooves or recesses 43C in radially opposite positions on the above-mentioned grip surfaces 43B for engagement with coupling rods 65D of a head gripper 65 which will be described after.

Indicated at 44 is an air motor which is provided in the motor receptacle cavity 43A of the body 43. In this instance, the air motor 44 is constituted by a motor case 44A, an axial stepped bore 44B which is formed axially through the motor case 44A and provided with a large diameter portion and a small diameter portion respectively on the front and rear sides thereof, a rotational shaft 44C which is axially extended in the large diameter portion of the stepped bore 44B and projected out of the motor case 44A at its fore end, an air turbine 44D which is fixedly mounted on the rotational shaft 44C on the side of the rear end of the rotational shaft 44C, an air bearing 44E which is provided in the motor case 44A in small gap relation with the rotational shaft 44C and around the axial bore 44B, and a hollow passage 44F which is formed axially and internally through the rotational shaft 44C to serve as a feed tube passage hole 48, which will be described hereinafter.

Indicated at 45 is a bell cup which is mounted on the air motor 44, more specifically, on a front end portion of the rotational shaft 44C. This bell cup 45 is put in high speed rotation by the air motor 44 and functions to centrifugally atomize paint which is spurted forward through the feed tube 38.

Denoted at 46 is a shaping air ring which is mounted on the front side of and between fore ends of the air motor 44 and the body 43. This shaping air ring 46 functions to spurt out air for shaping atomized paint particles, which are sprayed by the bell cup 45, into a desired spray pattern.

Indicated at 47 is a tube guide on the side of the head, which is formed centrally in a rear end portion of the body 43. More specifically, the tube guide 47 is formed in a stepped cylindrical shape, internally defining a hollow passage 47A which forms part of the feed tube passage hole 48. Further, the tube guide 47 is adapted to locate the feed tube passage holes 19 and 48 in coaxial relation with each other when the bell-shape head 42 is connected to the common main assembly body 11, and, when the feed tube 38 is inserted thereinto, guide the feed tube 38 toward the hollow passage 44F by its fore end portion which is extended into the air turbine 44D of the air motor 44.

Indicated at 48 is a feed tube passage hole on the side of the head, consisting of the hollow passage 44F of the air motor 44 and the hollow passage 47A of the tube guide 47. This feed tube passage hole 48 is formed in coaxial relation with the feed tube passage hole 19 on the side of the main assembly body.

Indicated at 49 is a cable passage hole which is formed through and between rear end portions of the body 43 and the motor case 44A of the air motor 44. This cable passage hole 49 provides a passage for guiding the plug 21A of the optical fiber cable 21 as far as a position in the vicinity of the air turbine 44D.

Denoted at 50 is a shaping air passage on the side of the head, more specifically, in a rear end portion of the body 43. When connected with the shaping air passage 22 on the side of the main assembly body, shaping air is supplied from this shaping air passage 50 toward the shaping air ring 46.

Indicated at 51 is a turbine air passage (see FIG. 9) on the side of the head, extended between the rear end of the body 43 and motor case 44A of the air motor 44. When connected with the turbine air passage 23 on the side of the main assembly body, turbine driving air is supplied from the turbine air passage 51 to the air turbine 44D of the air motor 44.

Designated at 52 is a brake air passage on the side of the head, extended between the body 43 and the motor case 44A. When connected with the brake air passage 24 on the side of the main assembly body, brake air is supplied from the brake air passage 52 to the air turbine 44D of the air motor 44.

Further, indicated at 53 is a bearing air passage on the side of the head, extended between the rear end of the body 43 and the motor case 44A of the air motor 44. This bearing air passage 53 is connected to the bearing air passage 25 on the side of the main assembly body.

In this instance, the bearing air passage 53 is constituted by an air inflow section 53A to be connected with the joint tube portion 25A of the bearing air passage 25, an air outflow passage section 53B extended to the air bearing 44E of the air motor 44, an on-replacement air inflow section 53C communicated with the air inflow section 53A and opened toward circumferential surfaces of the body 43, and a shuttle valve receptacle portion 53D formed at a junction of the above-mentioned air inflow and outflow sections 53A, 53B and 53C.

Indicated at 54 is a shuttle valve which is received in the shuttle valve receptacle portion 53D of the bearing air passage 53. While bearing air is supplied from the bearing air passage 25, the shuttle valve 54 closes the on-replacement air inflow section 53C, so that bearing air which is supplied from the side of the main assembly body is sent forward toward the air bearing 44E of the air motor 44 through the air outflow passage section 53B. On the other hand, when bearing air is supplied from a bearing air supply mechanism 67 which is connected to the on-replacement air inflow section 53C as will be described hereinafter, the shuttle valve 54 closes the air inflow section 53A so that this time the air bearing 44E of the air motor 44 is supplied with bearing air from the bearing air supply mechanism 67.

Thus, a cartridge-type bell-shape sprayer 55 according to the present embodiment is assembled into an operative form by detachably connecting the bell-shape head 42 to the head connecting portion 15 of the common main assembly body 11. The bell-shape head 42 is stably and fixedly connected to the head connecting portion 15 by suction grip upon sucking air through the air suction passage 26, out of the vacuum space 27 which is formed between the head connecting portion 15 and the rear or inner end of the bell-shape head 42. Further, upon supplying air to the vacuum space 27, the bell-shape head 42 becomes detachable from the head connecting portion 15.

Now, the description is directed to a head changer 61 which is capable of gripping and handling bell-shape heads of various colors at the time of replacing a bell-shape head on the common main assembly body 11 of the coating robot 6.

Indicated at 61 is the head changer which is located in a suitable position within working areas of the coating robot 6. As shown in FIGS. 11 through 16, the head changer 61 is constituted by a mount plate 62, head gripping mechanism 63, bearing air supply mechanism 67, washing mechanism 70 and so on.

Figure 11:
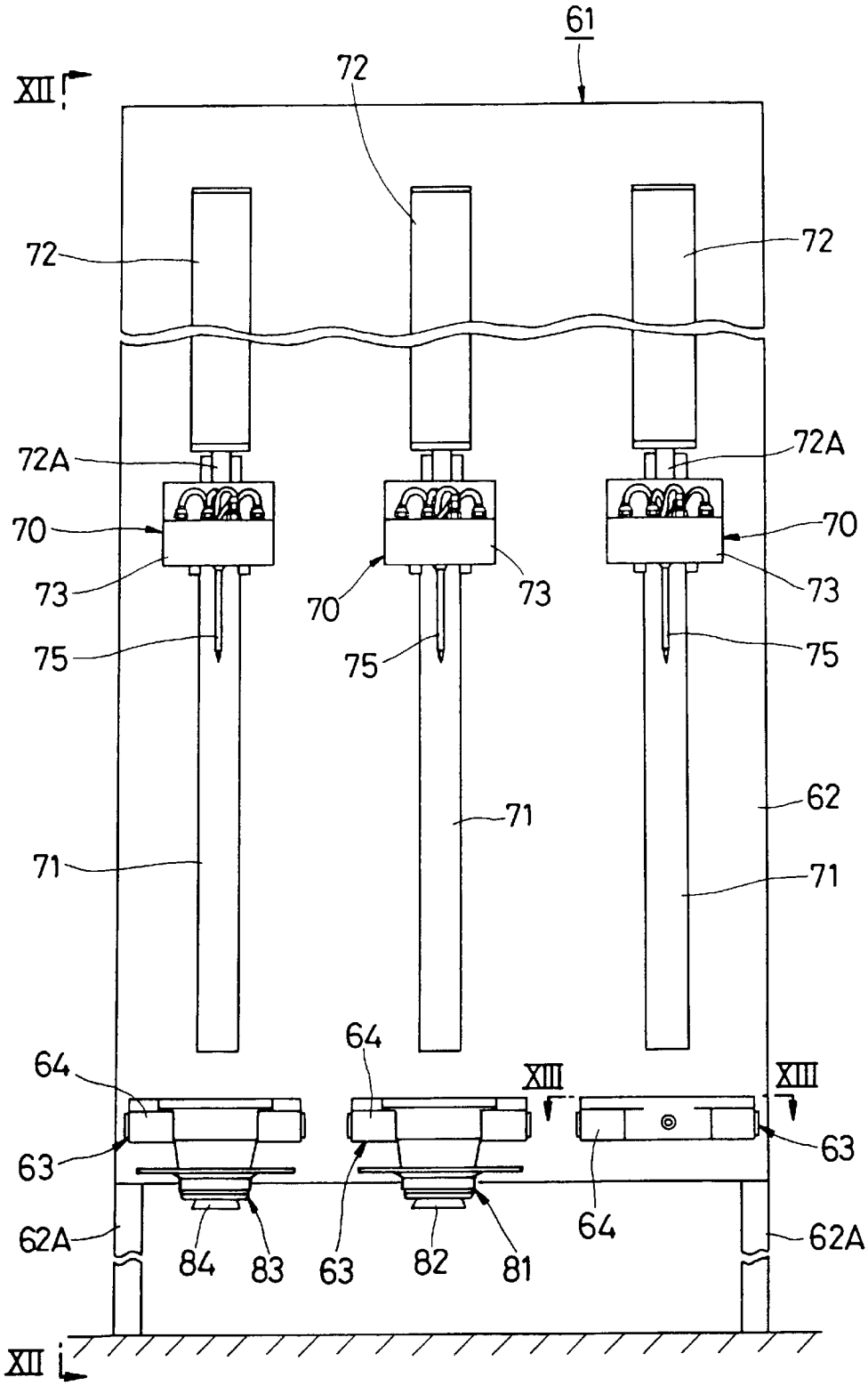
FIG. 11 is a front view of a head changer.
Figure 12:
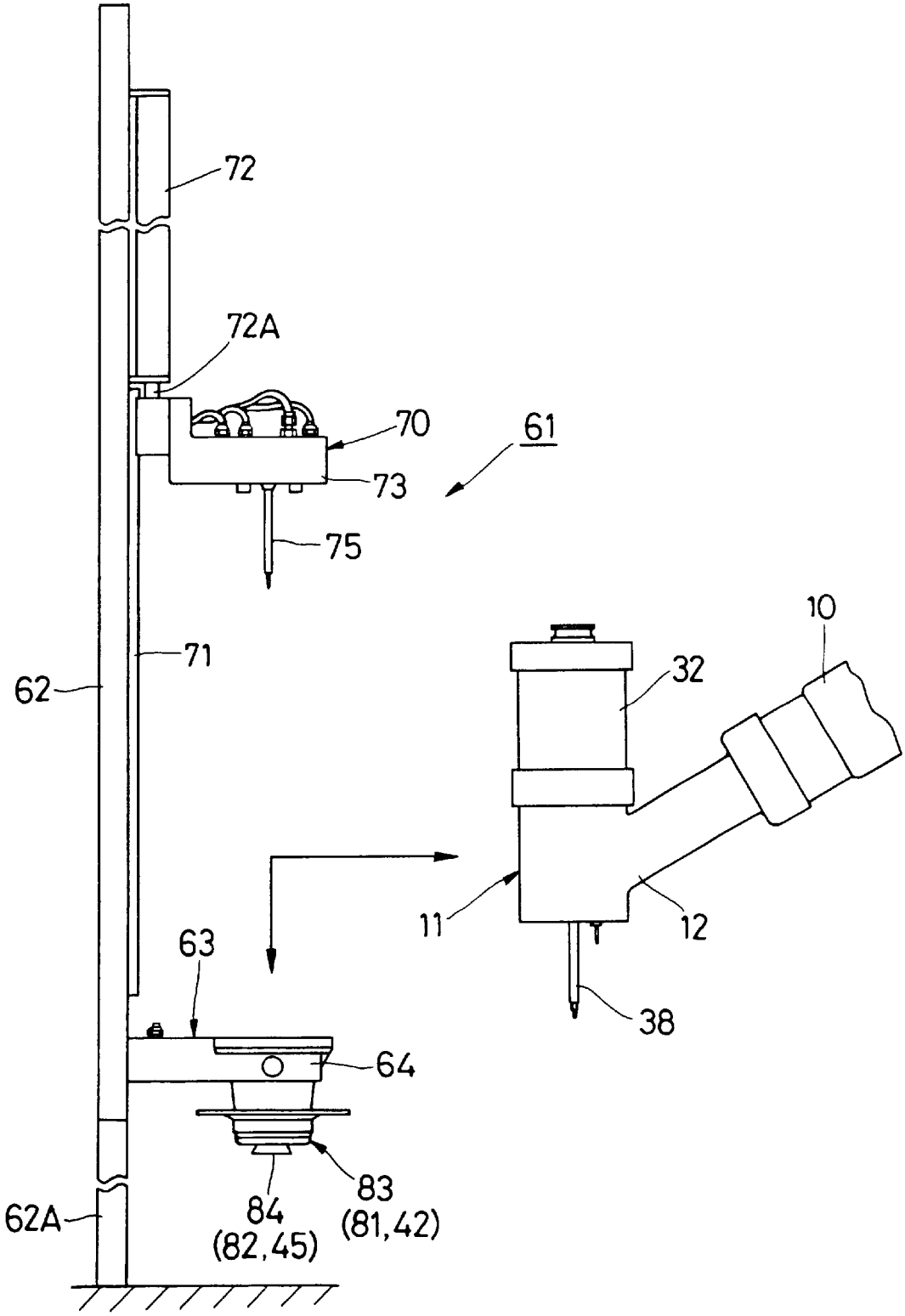
FIG. 12 is a left-hand side view of the head changer, taken in the direction of arrows XII—XII of FIG. 11.

Indicated at 62 is a mount plate which is provided in a replacing zone B (see FIG. 2) within working areas of the coating robot 6. As shown in FIGS. 11 and 12, the mount plate 62 is of a rectangular shape having its longitudinal sides in the vertical direction, and arranged to stand up on a floor through support means such as leg portions 62A.

Figure 13:
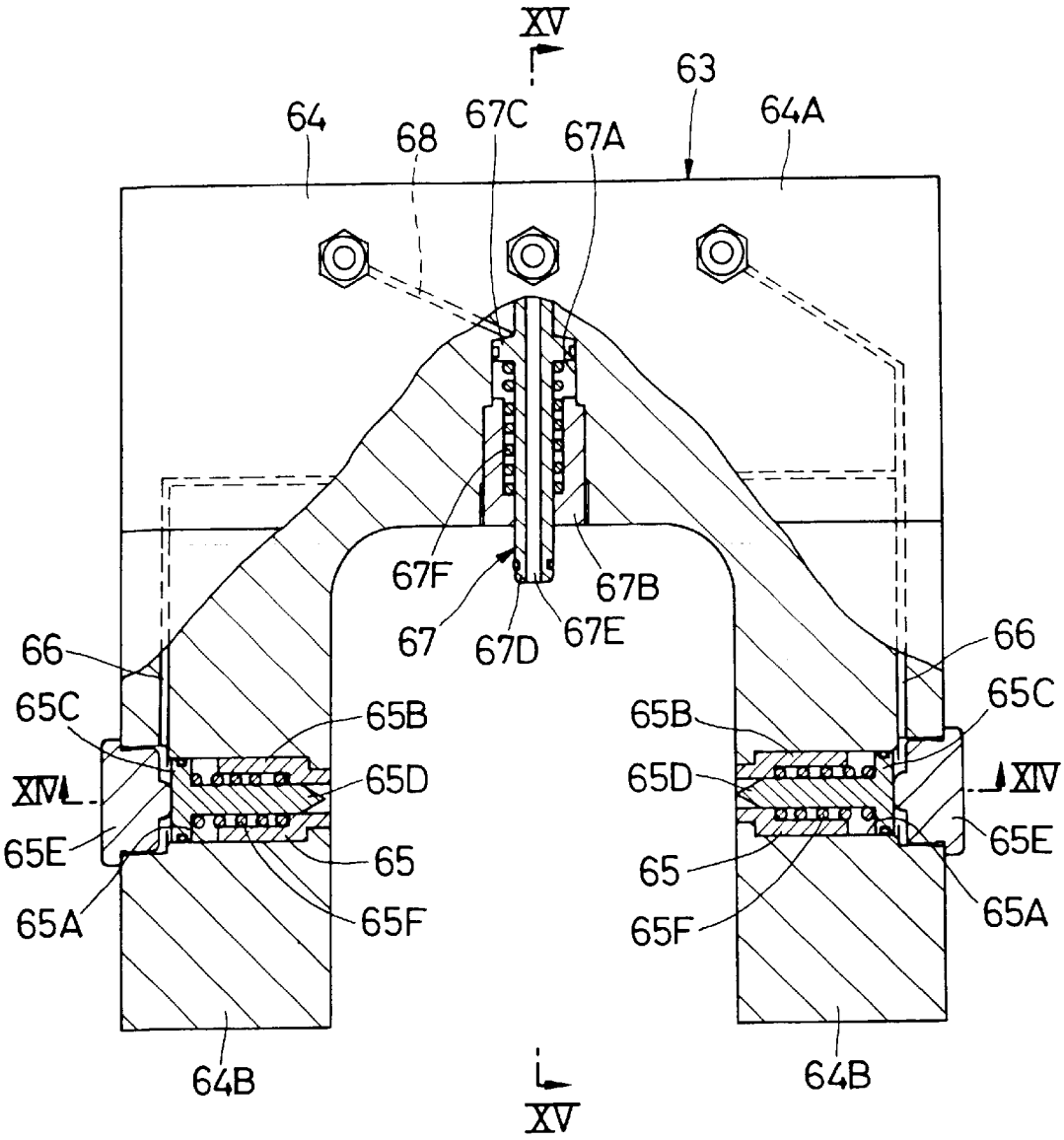
FIG. 13 is an enlarged partly cutaway plan view of a head gripper mechanism and a bearing air supply mechanism, taken in the direction of arrows XIII—XIII of FIG. 11.
Figure 14:
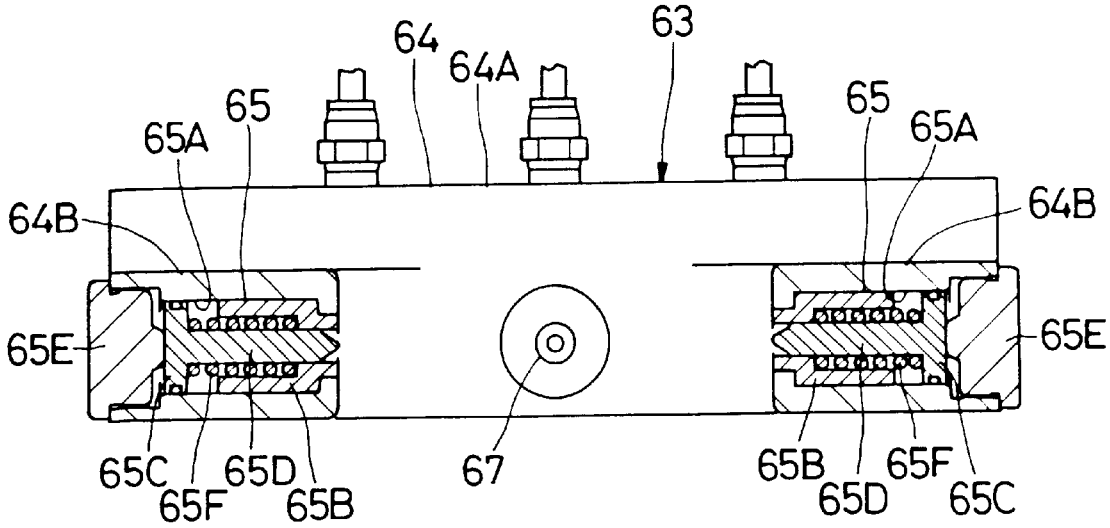
FIG. 14 is a sectional view of the head gripper mechanism, taken in the direction of arrows XIV—XIV of FIG. 13.
Figure 15:
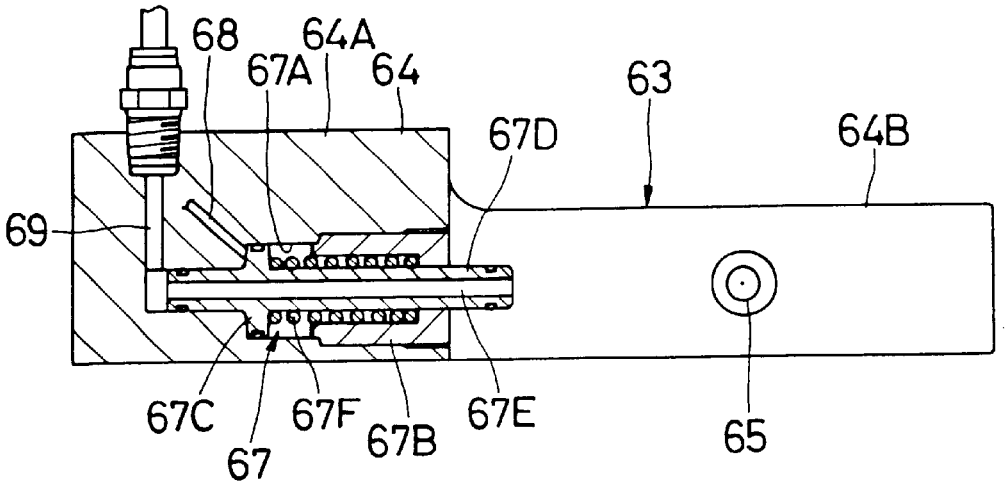
FIG. 15 is a sectional view of the head gripper mechanism, taken in the direction of arrows XV—XV of FIG. 13.

Indicated at 63 are three head gripping mechanisms which are mounted side by side on lower portions of the mount plate 62. Each one of the head gripping mechanisms 63 is arranged to grip a used bell-shape head after a coating operation and, after a washing operation on the used bell-shape head, then to grip a bell-shape head which is in a waiting position for replacement. In this instance, the respective head gripping mechanism 63 are disposed face to face with the coating robot 6 and located at predetermined intervals in the work piece 6 transfer direction. Further, as shown in FIG. 13, each head gripping mechanism 63 is constituted by a head receptacle 64 and a head gripper 65 which will be described hereinafter.

Denoted at 64 is the head receptacle which constitutes a main body of the head gripping mechanism 63 and functions to support the bell-shape head 42 and so on. In this instance, each head receptacle 64 is generally formed in U-shape, including a thick rectangular base plate 64A which is supported on the mount plate 62 and a pair of arms 64B which are extended forward from opposite longitudinal ends of the base plate 64A in laterally spaced relation with each other. More specifically, the support arms 64B are spaced from each other by a distance which is larger than the distance between the grip surfaces 43B on the body 43 of the bell-shape head 42.

Further, a piston sliding bore 67A is formed at a longitudinally center position of the base plate 64A for the bearing air supply mechanism 67 which will be described after. On the other hand, piston sliding bores 65A of head grippers 65 are formed in the support arms 64B substantially in coaxial relation with each-other and in a direction perpendicular to the afore-mentioned piston sliding bore 67A, respectively.

Indicated at 65 are a pair of head grippers which are provided on the support arms 64B face to face with each other. These head grippers 65 are arranged to grip a bell-shape head 42 laterally from opposite sides. In this instance, each head grippers 65 are constituted by piston sliding bores 65A which are formed in the support arms 64B substantially in coaxial relation with each other, rod guides 65B each in the form of a stepped tube and fitted in the piston sliding bore 65A, pistons 65C which are received in the piston sliding bores 65A and movable toward and away from each other, clasping rods 65D which are extended axially inward from the respective pistons 65C toward and through said rod guides 65B, closure plugs 65E closing outer ends of the piston sliding bores 65A in a sealed state, and coil springs 65F urging the clasping rods 65D toward the respective closure plugs 65E.

Figure 17:
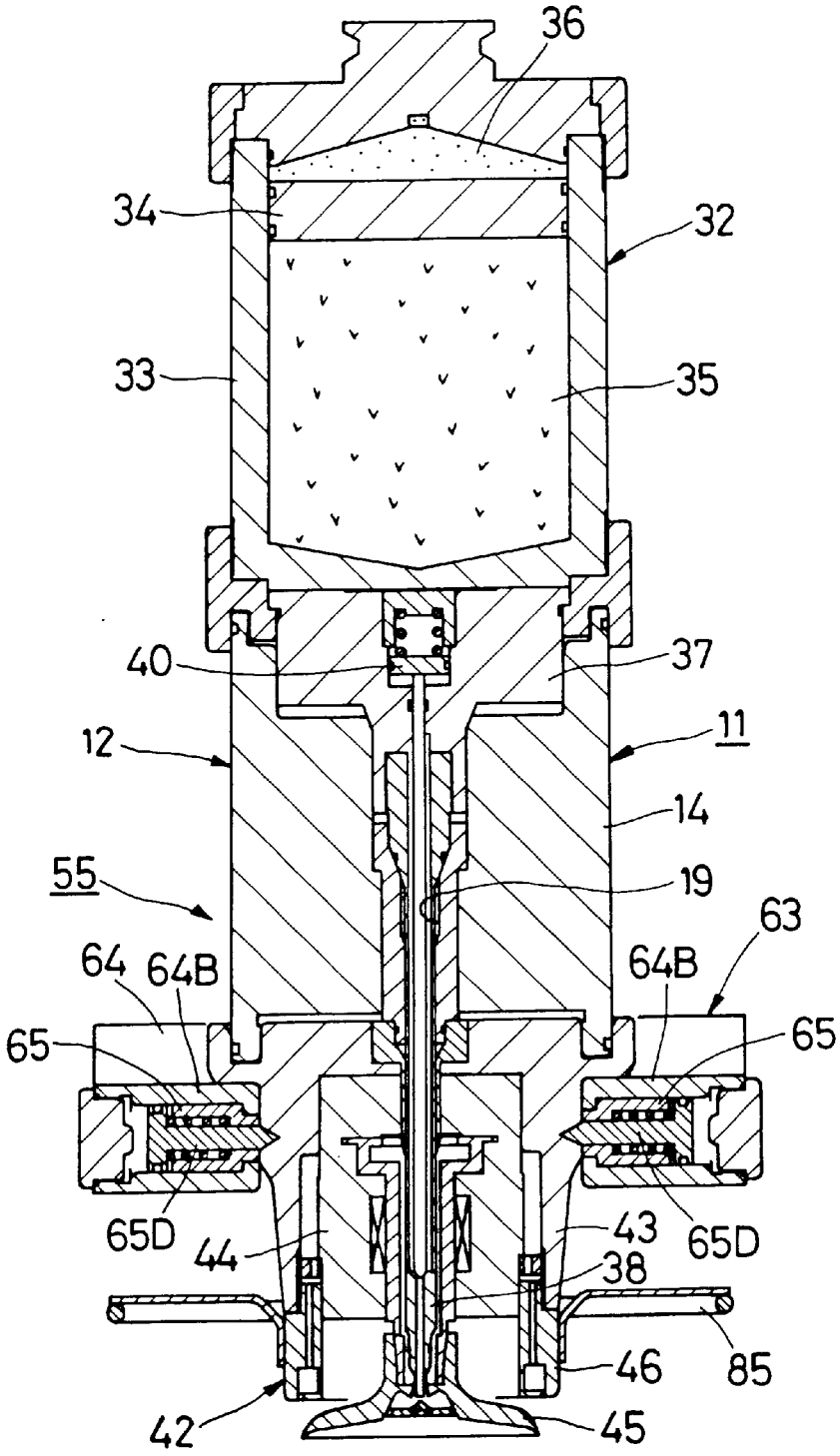
FIG. 17 is a vertical sectional view of the bell-shape head which is located in the headIchanging position of the head changer, along with the common main assembly body and paint cartridge, taken in the direction of arrows XVII—XVII of FIG. 16.

Normally, the clasping rods 65D have the respective fore or inner ends retracted into the rod guides 65B under the influence of biasing force of the coil springs 65F. On the other hand, when air is supplied through air passages 66, the fore ends of the clasping rods 65D are projected out of the rod guides 65B to engage in recesses 43C which are formed on the body 43 of the bell-shape head 42, as shown in FIG. 17.

Indicated at 67 is a bearing air supply mechanism which is provided on the base plate 64A of the head receptacle 64. The bearing air supply mechanism 67 serves to supply bearing air to the air bearing 44E of the air motor 44 while a bell-shape head 42 is gripped by the head gripping mechanism 63. In this instance, the bearing air supply mechanism 67 is constituted by a piston sliding bore 67A which is formed in a longitudinally center portion of the base plate 64A and opened at a deep position between the two support arms 64B, rod guide 67B in the shape of a stepped tube which is fitted in the piston sliding bore 67A, a piston 67C which is displaceably received in the piston sliding bore 67A, a connecting rod 67D which is extended axially forward from the piston 67C and has its fore end projected out of the rod guide 67B, an air supply passage 67E which is formed axially and centrally through the connecting rod 67D, and a coil spring 67F which is arranged to urge the connecting rod 67D toward the base or rear end of the piston sliding bore 67A.

Figure 16:
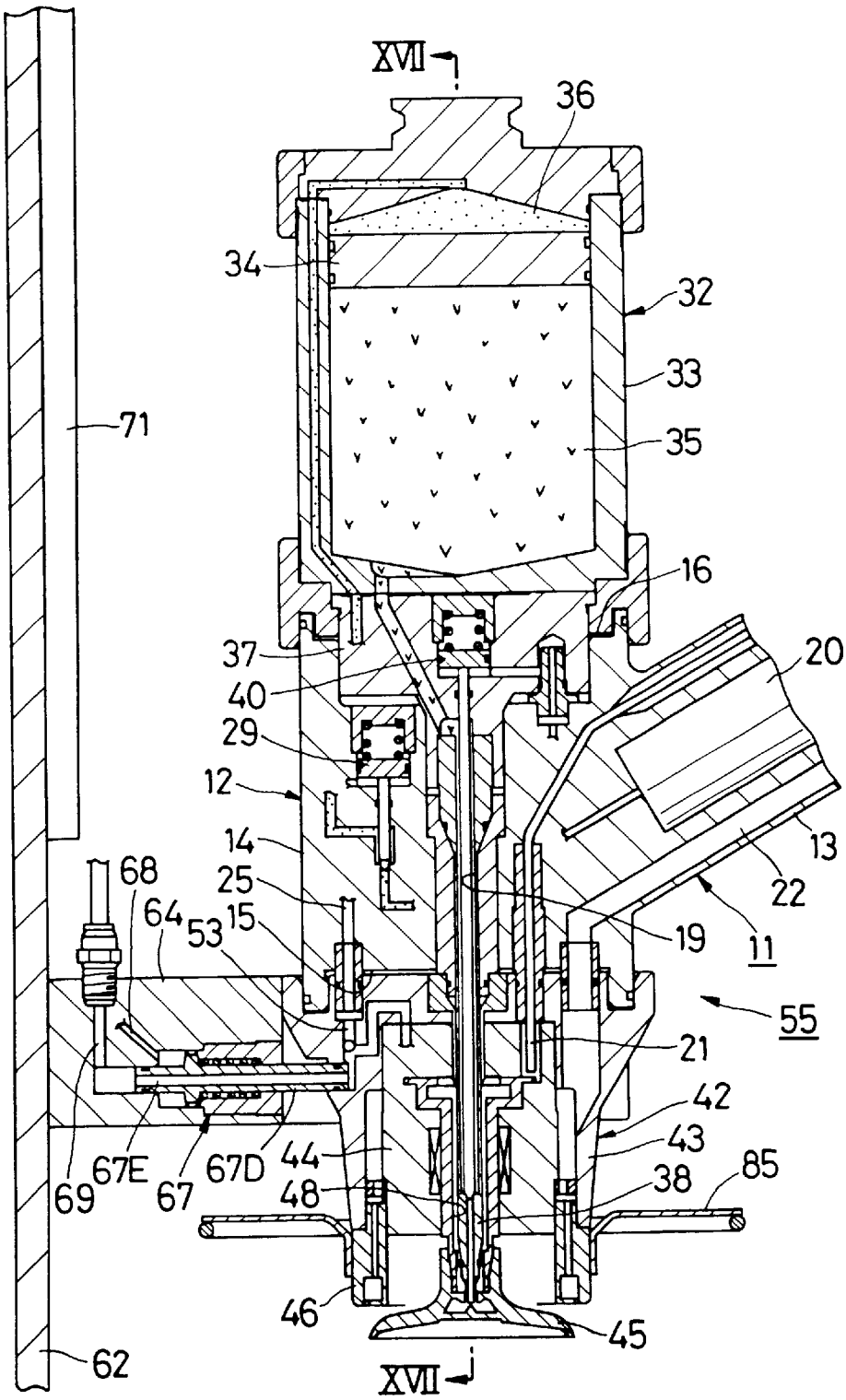
FIG. 16 is a vertical sectional view of the bell-shape head which is located in a head changing position of the head changer, along with the common main assembly body and paint cartridge.

Normally, the connecting rod 67D is held in a shrunk state under the influence of the biasing force of the coil spring 67F. On the other hand, as shown in FIG. 16, when air is supplied through the air passage 68, the connecting rod 67D is extended out and connected to the on-replacement air inflow section 53C of the bearing air passage 53 which is formed in the body 43 of the bell-shape head 42. Thus, the bearing air supply mechanism 67 functions to supply bearing air to the air bearing 44E of the air motor 44 through bearing air passage 69, air supply passage 67E and bearing air passage 53.

Figure 19:
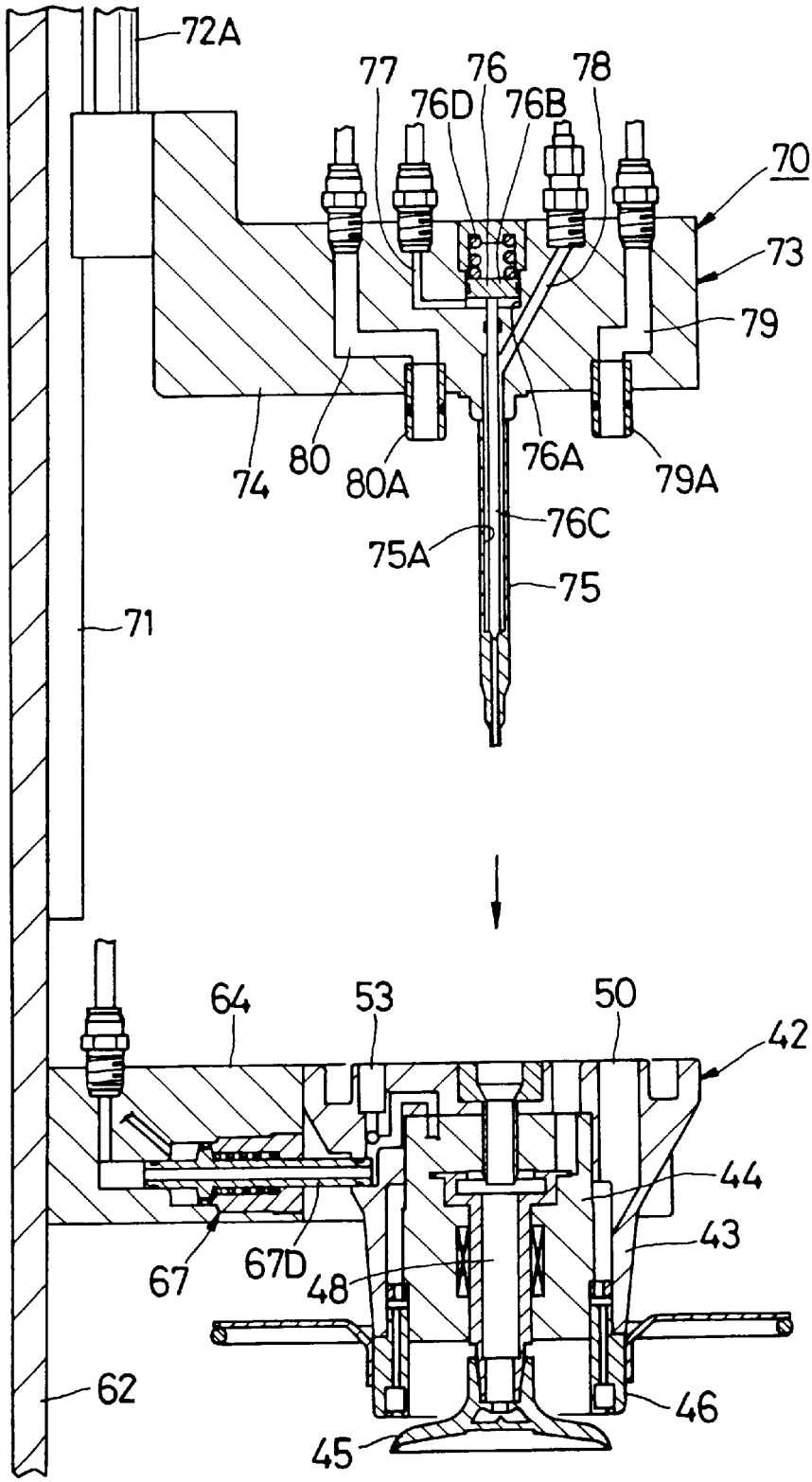
FIG. 19 is a vertical sectional view of a washing mechanism which is being lowered toward the bell-shape head which is gripped on the head gripper mechanism.
Figure 20:
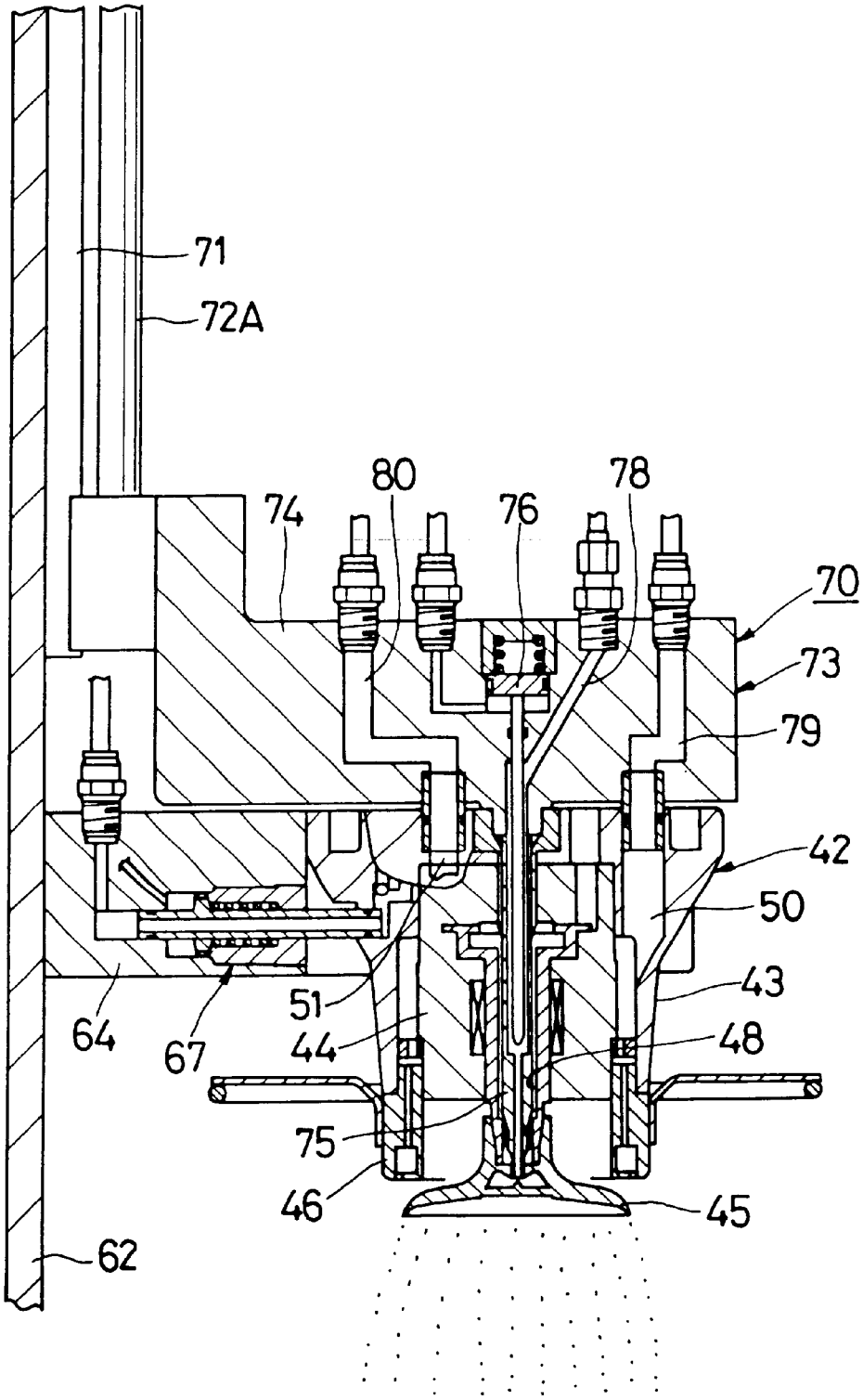
FIG. 20 is a vertical sectional view of the bell-shape head which is being washed by the washing mechanism.

Indicated at 70 are three washing mechanisms which are vertically movably provided on the mount plate 62 in confronting positions relative to and on the upper side of the respective head gripping mechanisms 63. Each one of the washing mechanisms 70 functions to wash away deposited paint on a bell cup 45 of a used bell-shape head 42 which is gripped on a head gripping mechanism 63 in a vertically confronting position. In this instance, as shown in FIGS. 11, 19 and 20, each one of the washing mechanisms 70 is largely constituted by an elongated rail 71 which is mounted vertically on the mount plate 62, a washing assembly 73 which is movable up and down along the rail 71, and a cylinder device 72 which is mounted on the mount plate 62 on the upper side of the rail 71 to support the washing assembly 73 vertically movably at a lower end of a rod member 72A.

Indicated at 73 is the washing assembly which constitutes a main part of each washing mechanism 70. As shown in FIGS. 19 and 20, each washing assembly 73 is largely constituted by a lift block 74, a thinner tube 75, a thinner valve 76, a shaping air passage 79, and a turbine air passage 80.

Indicated at 74 is the lift block which is movable up and down along the rail 71 and mounted at the lower end of the rod member 72A of the cylinder device 72. Accordingly, by contraction and extension of the rod member 72A, the lift block 74 is moved in upward and downward directions.

Denoted at 75 is the thinner tube which is located substantially at the center on the lower side of the lift block 74 to serve as a wash fluid supply tube. The thinner tube 75 functions to supply a wash fluid like thinner toward a bell cup 45 of a bell-shape head 42 which is gripped on the head gripper 65, for washing the bell cup 45. In this instance, the thinner tube 75, internally providing a thinner supply passage 75A, is extended downward from the lower side of the lift block 74. When the lift block 74 is lowered, the thinner tube 75 is inserted into a thinner tube passage hole 48 on the part of the bell-shape head 42 which is gripped on the head gripping mechanism 63.

Indicated at 76 is a thinner valve which is provided on the lift block 74 at a position on the upper side of the thinner tube 75. The thinner valve 76 functions to open and close the thinner supply passage 75A of the thinner tube 75. In this instance, the thinner valve 76 is largely constituted by a cylinder bore 76A which is formed vertically and substantially at the center of the lift block 74, a piston 76B which is axially slidably fitted in the cylinder bore 76A, a valve member 76C which has its base end securely fixed to the piston 76B and its fore end extended substantially coaxially into the thinner tube 75, and a valve spring 76D which is adapted to urge the valve member 76C in an closing direction through the piston 76B.

Normally, the thinner supply passage 75A of the thinner tube 75 is closed by the valve member 76C of the thinner valve 76 under the influence of biasing action of the valve spring 76D. On the other hand, when pilot air is supplied through a pilot air passage 77, the valve member 76C is moved through the piston 76B to open the thinner supply passage 75A, thereby permitting circulation of thinner which is supplied through a thinner passage 78.

Indicated at 79 is a shaping air passage which is formed in the lift block 74. This shaping air passage 79 has a joint tube 79A attached to its lower open end. Further, indicated at 80 is a turbine air passage which is also formed in the lift block 74, similarly having a Joint tube 80A attached to its lower open end. While a bell cup 45 is being washed, air is supplied through these air passages 79 and 80, thereby spurting out shaping air and rotating the bell cup 45 at high speed by the air motor 44.

Indicated at 81 is another bell-shape head which is gripped on one of the head gripping mechanism 63 of the head changer 61. For example, the bell-shape head 81 is provided with a bell cup 82 which is smaller in diameter than the bell cup 45 of the above-described bell-shape head 42.

Further, exemplified at 83 is still another bell-shape head with a bell cup 84 which is smaller in diameter than the bell cup 82 of the just-mentioned bell-shape head 81.

Furthermore, denoted at 85 is an annular repulsive electrode which is provided on the outer peripheral side of the body 43 of the bell-shape head 42. This repulsive electrode 85 is applied with a high voltage of the same potential as the negative high voltage which is applied to the bell cup 45. As a consequence, through homopolar repulsion, negatively charged paint particles are prevented from depositing on outer peripheral surfaces of the body 43.

The automatic coating apparatus 4 with the above-described arrangements according to the present embodiment operates in the manner as described below.

Firstly, in the case of coating a vehicle body 2 which is transferred by the conveyer 3, the coating robot 6 is put in a tracking movement along the track rail 5 while coating the vehicle body by the use of the coating robot 6. At this time, a paint cartridge 32 which is filled with paint of a desired color is set in the cartridge loading cavity 16 within the housing 12. In addition, of the various bell-shape heads 42, 81, 83 and so on, the bell-shape head 42 which is capable of spraying paint over a broad range, that is to say, which is suitable for coating exterior panels of the vehicle body 2 is connected to the head connecting portion 15 of the housing 12. Consequently, by way of the common main assembly body 11 and the cartridge 32, the sprayer can be set up as a cartridge-type bell-shape sprayer 55 which is suitable for coating exterior panels of the vehicle body.

Then, as soon as the coating robot 6 comes face to face with the vehicle body 2, shaping air is supplied to the shaping air ring 46 through the shaping air passages 22 and 50, and at the same time turbine driving air is supplied to the air turbine 44D of the air motor 44 through the turbine air passages 23 and 51, and bearing air is supplied to the air bearing 44E through the bearing air passages 25 and 53. As a result, the bell cup 45 is put in high speed rotation by the air motor 44 and shaping air is spurted out from the shaping air ring. Besides, a high voltage is applied to paint from the high voltage generator 20 through the feed tube 38 of the paint cartridge 32.

In this state, the thinner valve 29 and paint valve 40 are opened. Upon opening of the thinner valve 29, paint-extruding thinner is allowed to flow into the thinner chamber 36 through the thinner passages 28 and 39, therey pushing the piston 34 forward to feed paint from the paint chamber 35 toward the feed tube 38. Since the paint valve 40 is opened, paint is supplied from the feed tube 38 toward the bell cup 45 of the cartridge-type bell-shape sprayer 55. The bell cup 45 is in high speed rotation at this time, paint is thereby sprayed toward exterior panel portions of the vehicle body 2.

Upon completing coating of exterior panel portions of the vehicle body 2, the operation normally proceeds to coating of interior panels of the vehicle body 2. In such a case, the bell-shape head is replaced by the bell-shape head 81 with the bell cup 82 of a smaller diameter which is more suitable for coating complicate coating surfaces of interior panels from the bell-shape head 42 for exterior panels.

Therefore, for unloading the bell-shape head 42 which was used for the exterior coating, the coating robot 6 is operated to move the bell-shape head 42 to a head gripping mechanism 63 of the head changer 61. Then, as shown in FIGS. 16 and 17, the body 43 of the bell-shape head 42 is located between the support arms 64B of the head receptacle member 64.

At this time, the clasping rods 65D of the head gripper 65 are brought into engagement with the recesses 43C on the part of the body 43 to grip the bell-shape head 42 firmly therebetween.

Substantially concurrently, the connecting rod 67D of the bearing air supply mechanism 67 is extended out and fittingly connected to the on-replacement air inflow port 53C of the bearing air passage 53. In this state, bearing air is supplied to the bearing air passage 53 on the side of the head by the bearing air supply mechanism 67 through the bearing air passages 69 and the air passage 67E. On the other hand, at the side of the main assembly body, bearing air supply is stopped from the bearing air passage 25.

Consequently, since bearing air is supplied to the air bearing 44E of the air motor 44 from the head changer 61, bearing air is constantly supplied to the air bearing 44E to hold the rotational shaft 44C smoothly in rotation even after the bell-shape head 42 has been separated from the common main assembly body 11.

Figure 18:
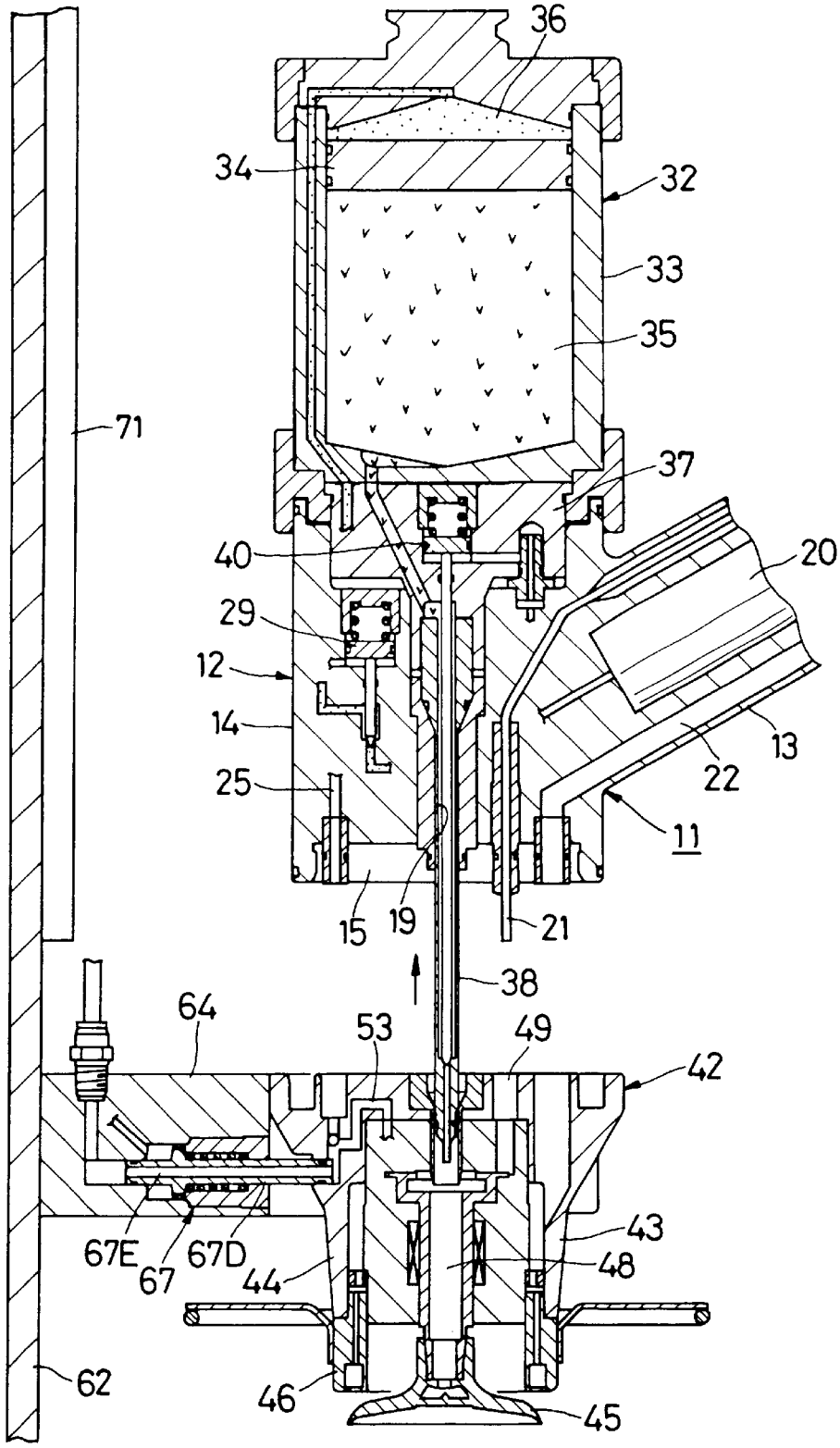
FIG. 18 is a vertical sectional view of the bell-shape head which is being separated from the common main assembly body in an upward direction.

In a next step, air is supplied to the vacuum space 27 to cancel the suction grip which holds the bell-shape head 42 fixedly to the common main assembly body 11. Then, as illustrated in FIG. 18, the common main assembly body 11 is moved upward to disconnect same from the bell-shape head 42, extracting the feed tube 38 from the bell-shape head 42. Now, the used bell-shape head 42 can be dismantled from the coating robot 6.

Now, the coating robot 6 can proceed to a next coating operation using one of the washed or fresh bell-shape heads 81 and 83 which are in the respective waiting positions.

For this purpose, of the bell-shape heads 81 and 83 which wait in a clean and fresh state, the coating robot 6 is moved to locate the common main assembly body 11, for example, on the upper side of the bell-shape head 81 with a relatively small spray pattern. The common main assembly body 11 is then lowered to insert the feed tube 38 into the bell-shape head 81. Succeedingly, after connecting the bell-shape head 81 to the common main assembly body 11, the head gripping mechanism 63 is disengaged to release the bell-shape head 81. As a consequence, the bell-shape head 81 can now be picked up from the head changer 61 by the coating robot 6. Then, the coating robot 6 proceeds to coating of interior panels of the vehicle body 2, using the new bell-shape head 81.

In the meantime, the used bell-shape head 42 which has been detached from the common main assembly body 11 is washed clean by the washing mechanism 70.

More specifically, as shown in FIG. 19, the cylinder device 72 is operated to lower the washing assembly 73 toward the bell-shape head 42, and then the washing assembly 73 is connected to the bell-shape head 42, thereby passing the thinner tube 75 of the washing assembly 73 into the feed tube passage hole 48 on the side of the bell-shape head 42. In this state, shaping air is supplied through the shaping air passage 79 of the washing mechanism 70 and spurted out from the shaping air ring 46, thereby preventing thinner from scattering around during the washing operation along with paint which is released and sprayed by the bell cup 45. At the same time, turbine driving air is supplied to the turbine air passage 80 of the washing mechanism 70 to put the bell cup 45 in high speed rotation by the air motor 44.

Then, as shown in FIG. 20, the thinner valve 76 of the washing mechanism 70 is operated to open the thinner supply passage 75A of the thinner tube 75, thereby supplying thinner toward the bell cup 45 via the thinner passage 78 and thinner supply passage 75A. Accordingly, concurrently with the interior panel coating operation by the other bell-shape head 81, the bell-shape head 42 can be washed with thinner which is supplied from the thinner tube 75 of the washing mechanism 70.

Further, upon finishing the washing operation on the bell-shape head 42, the cylinder device 72 is operated to lift up the washing assembly 73 into the upper position, thereby leaving the bell-shape head 42 in a waiting state on the head gripper 65. When it becomes necessary to use the washed bell-shape head 42 again, the common main assembly body 11 between the bell-shape head 42 and the washing assembly 73 and picked up by the coating robot 6 after connecting the bell-shape head 42 with the common main assembly body 11.

As described above, according to the present embodiment, the cartridge-type bell-shape sprayer 55 is constituted by the common main assembly body 11 which is provided at the fore end of the horizontal arm 9 of the coating robot 6 and the bell-shape head 42 which is detachably connected to the common main assembly body 11. Accordingly, at the time of coating the vehicle body 2, the paint which is supplied from the paint cartridge 32 is sprayed toward the vehicle body 2 by the bell-shape head 42.

Besides, bell-shape heads 81 and 83 of different spray patterns are provided in addition to the bell-shape head 42, thereby permitting to connect these bell-shape heads 42, 81 and 83 replaceably to the common main assembly body 11. It follows that, in case coating involves surfaces of different shapes and contours like exterior and interior panels of vehicle bodies 2, the bell-shape heads 81 and 83 which are suitable for coating interior surfaces can be selectively connected to the coating robot 6 and the common main assembly body 11 in place of the bell-shape head 42 which is particularly suitable for coating exterior panels. This means that it becomes possible to reduce the number of the coating robots 6 and to reduce the cost of the automatic coating apparatus 4 to a significant degree, at the same time making it possible to reduce its installation space and to downsize the coating booth 1.

Further, in a case where a plural number of bell-shape heads 42 of a similar shape are provided in a waiting state on the head changer 61 and an abnormality is found in a bell-shape head 42 which is currently in use, a spare bell-shape head 42 can be easily and quickly connected in place of the current bell-shape head 42, for the purpose of avoiding shutdown of the whole coating line and improving productivity of the line.

Further, for example, the head changer 61 is provided with three head gripping mechanisms 63, thereby holding two different bell-shape heads 81 and 83 respectively in waiting positions. Needless to say, these arrangements contribute to broaden the range of applications of the automatic coating apparatus 4.

On the other hand, the provision of the recesses 43C, which are the body 43 of the bell-shape head 42 for coupling engagement with clasping rods 65D on the part of the head gripper 65, makes it easier for the head gripping mechanism 63 to grip the bell-shape head 42 in a secure manner.

Further, at the time of washing the bell-shape head 42 by the washing mechanism 70 of the head changer 61, the washing assembly 73 is lowered toward the bell-shape head 42 which is gripped on the head gripper 65, to insert the thinner tube 75 into the feed tube passage hole 48 on the bell-shape head 42. In this state, the thinner valve 76 is opened to supply thinner toward the bell cup 45 through the thinner tube 75, for washing off paint which has deposited on the bell cup 45, and then the washed bell-shape head 42 is held in a waiting state in preparation for a next coating operation.

Further, at the time of washing the bell-shape head 42 by the washing assembly 73, shaping air is supplied to the bell-shape head 42 from and through the shaping air passage 79, to prevent thinner, which contains sprayed paint by the bell cup 45, from scattering around during the washing operation. Besides, since turbine air is supplied to the bell-shape head 42 from the turbine air passage 80, the bell cup 45 is put in high speed rotation during washing operation.

The vertically movable washing assembly 73 is separated into an upper waiting position away from the bell-shape head 42 after a washing operation, so that the coating robot 6 can easily connect the common main assembly body 11 to the washed bell-shape head 42.

Further, the head changer 61 is provided with the bearing air supply mechanism 67 to supply bearing air to the air bearing 44E of the air motor 44 on the bell-shape head 42, 81 or 83 which is gripped on the head gripping mechanism 63. Accordingly, even when the bell-shape head 42, for example, is detached from the common main assembly body 11, bearing air is supplied to the air bearing 44E to hydrostatically support the rotational shaft 44C, for preventing abrasive wear and damages to the rotational shaft 44C and prolonging the service life of the air motor 44.

Moreover, the vacuum space 27 is formed between the head connecting portion 15 of the common main assembly body 11 and the bell-shape head 42, 81 or 83, and air is sucked out from the vacuum space 27 through the air suction passage 26 to hold the bell-shape head 42, 81 and 83 in a fixedly locked state relative to the common main assembly body 11 by suction grip, thereby securely preventing dislocation or fall of the bell-shape head 42, 81 or 83.

Further, a plural number of paint cartridges 32 of different colors are repleaceably loadable in one common main assembly body 11, it becomes possible to omit paint hoses which would otherwise be required for supply of paint of different colors, and to construct the machine in a simplified form, obviating the so-called voltage block insulation structure.

Figure 21:
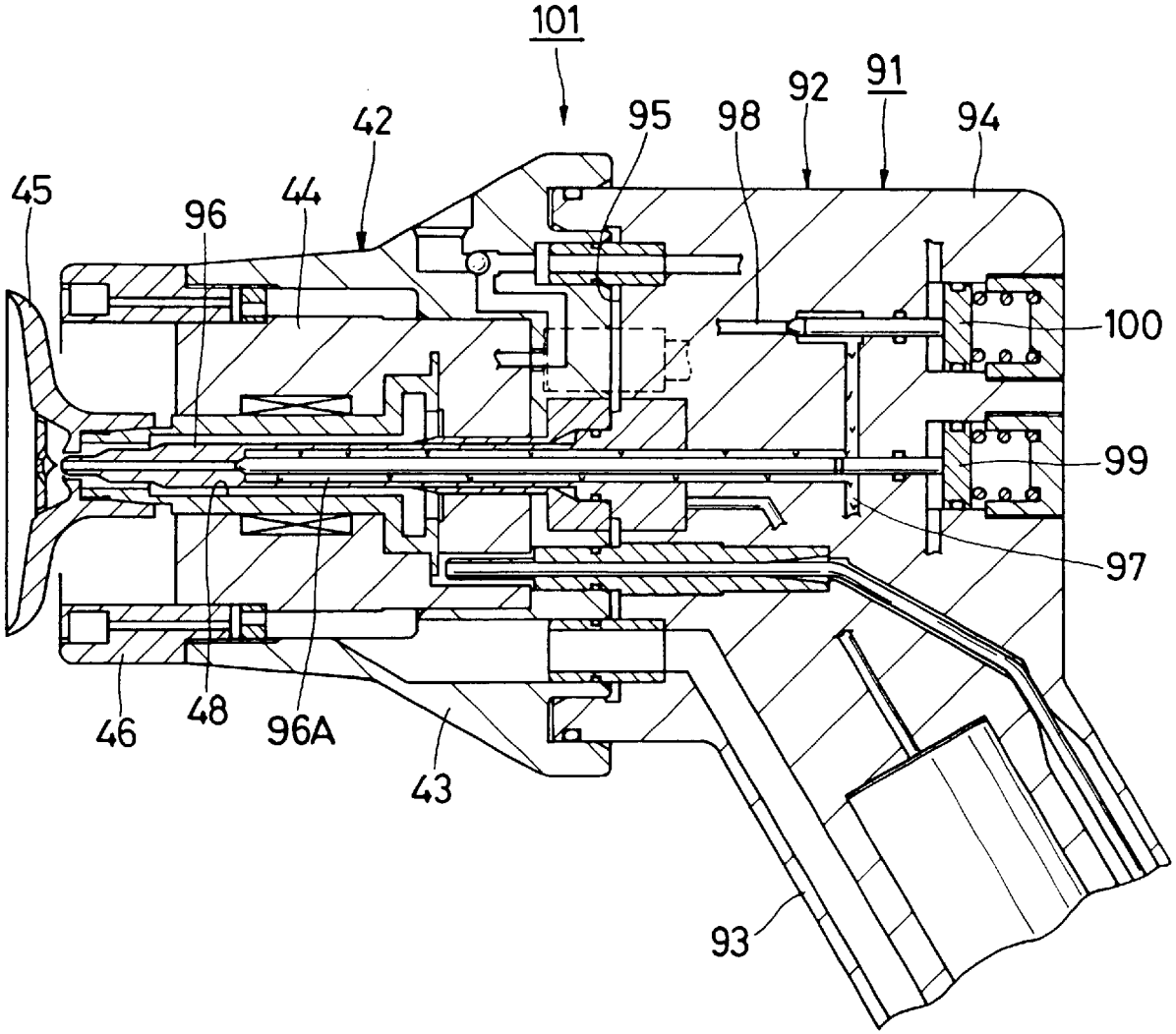
FIG. 21 is a vertical sectional view of a bell-shape head which is connected to a common main assembly body according to a second embodiment of the present invention.
Figure 22:
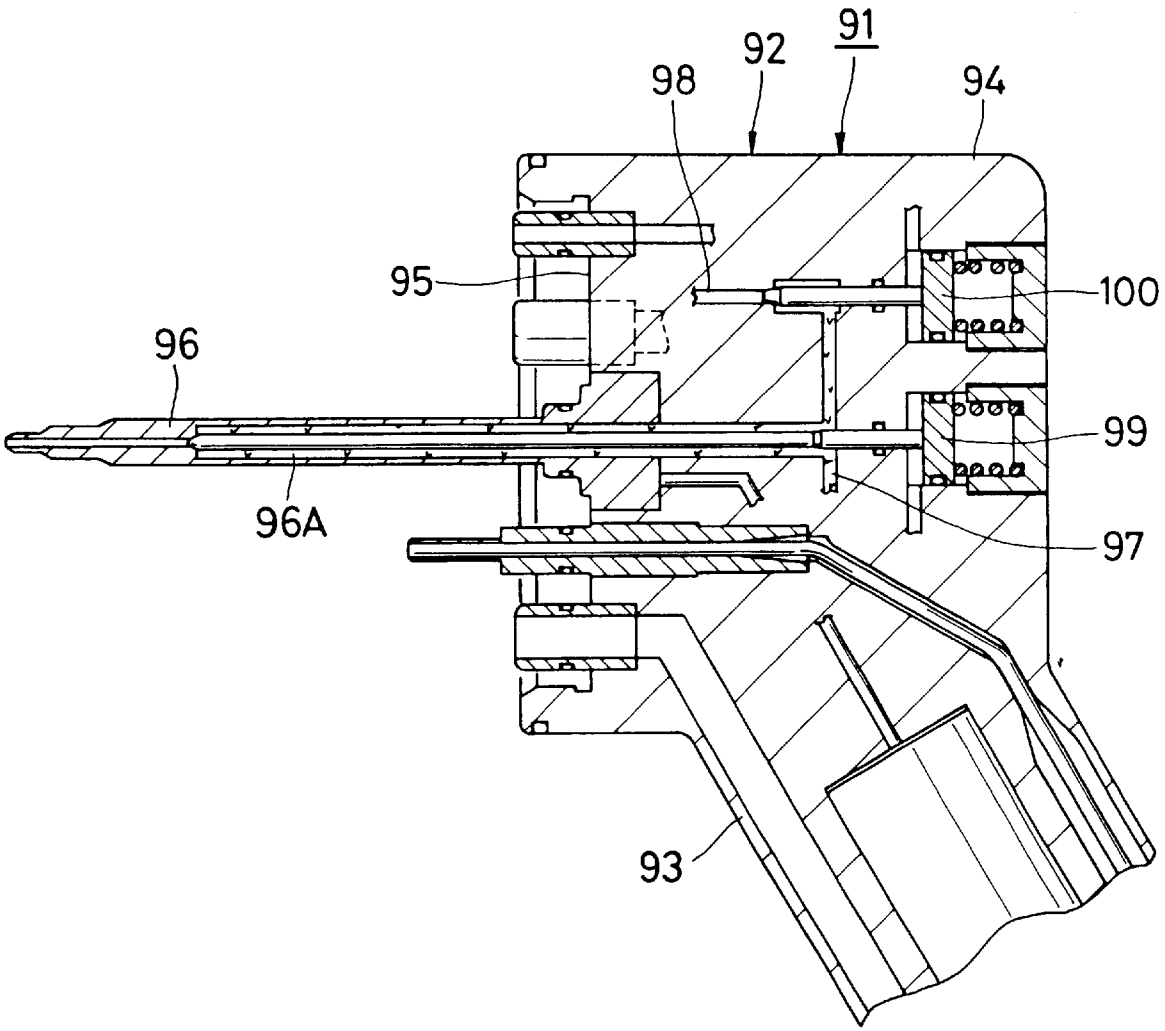
FIG. 22 is a vertical sectional view of the common main assembly body shown in FIG. 21.

Referring now to FIGS. 21 and 22, there is shown a second embodiment of the present invention, with features in that a bell-shape head is detachably connectable to a common main assembly body through a paint passage which supplies paint to the bell-shape head. In the following description of the second embodiment, those component parts which are common with the foregoing first embodiment are designated by common reference numerals or characters to avoid repetitions of same explanations.

Indicated at 91 is a common main assembly body according to the present embodiment. This common main assembly body 91 is largely constituted by a housing 92, a head connecting portion 95, a feed tube 96, a paint passage 97, a paint valve 99, a discharge valve 100 and so on, which will be described hereinlater. In this instance, the common main assembly body 91 constitutes a main body which can be applied commonly to bell-shape sprayers 101 which will be described after.

Indicated at 92 is the housing which is configured to form an outer shell of the common main assembly body 91, and constituted by a neck portion 93 mounted on the wrist 10 of the horizontal arm 9, and a mount block 94. In this instance, a head connecting portion 95 in the form of a cylindrical cavity is formed on the front side of the mount block 94 for replaceably connecting a bell-shape head 42 thereto.

Designated at 96 is the feed tube which is fixedly provided on the front side of the mount block 94 of the housing 92. More specifically, the feed tube 96 has its base end securely fixed to the mount block 94 and its fore end projected axially in the forward direction. Further, the feed tube 96 internally defines an axially extending paint supply passage 96A.

Indicated at 97 is the paint passage which is formed in and between the neck portion 93 and the mount block 94. This paint passage 97 is connectible to a paint supply source through a color changing valve device (both not shown) at its upstream end. The other downstream end of the paint passage 97 is connected to the paint passage 96A of the feed tube 96. Denoted at 98 is a discharge passage which is provided in communication with the paint passage 97.

Indicated at 99 is the paint valve which is provided in the mount block 94 of the housing 92 to open and close the paint supply passage 96A of the feed tube 96.

Indicated at 100 is the discharge valve which is provided in the mount block 94 of the housing 92 to open and close communication with the discharge passage 98 through which a previous color is discharged at the time of a color changing operation.

Thus, the present embodiment, with the arrangements as described above, can produce substantially the same operational effects as the foregoing embodiments. Particularly in the case of the present embodiment, the common main assembly body 91 is provided with the paint passage 97 which is connected to a paint supply source, so that it can spurt out paint of a desired color, which is selected by way of the color changing valve device, from the feed tube 96 through the paint passage 97. Therefore, a bell-shape sprayer 101, which operates on an ordinary paint supply system with a color changing valve, is set up and put in an operative state upon connecting a bell-shape head 42 to the head connecting portion 95 of the common main assembly body 91.

In the foregoing first embodiment, the head changer 61 is shown as being provided with three sets of head gripping and washing mechanisms 63 and 70. However, needless to say, the present invention is not limited to the particular arrangements shown. For example, two or four or more sets of head gripping and washing mechanisms 63 and 70 may be provided on the head changer 61 if desired.

Further, in the foregoing embodiments, as an example of working mechanism, the common main assembly body 11 or 111 is mounted on the wrist 10 of the coating robot 6. However, the present invention can be realized by the use of other working mechanisms. For example, if necessary, the common main assembly body 11 or 111 may be mounted on a side reciprocator or a top reciprocator.

Further, in the foregoing embodiments, the automatic coating apparatus 4 is shown as having the so-called direct charging system, in which paint is directly charged with the high voltage from the high voltage generator 20. However, the present invention is not limited to the particular charging system shown. If desired, the automatic coating apparatus can be configured into an indirect charging type, for example, with an external electrode provided on the outer peripheral side of the body 43 of the bell-shape head 42 to form a corona discharge region in such a way that paint particles are charged with a high voltage when they pass thereacross.

Furthermore, in the foregoing embodiments, the bell-shape heads 42, 81 and 84 are shown as being different from each other in diameter of the bell cups 45, 82 and 81. However, the present invention is not limited to this particular example. For instance, there may be employed a diversity of replaceable bell-shape heads which differ from each other in shape or material of bell cup or in diameter of repulsive electrode, if any.

Industrial Applicability

As described in detail hereinbefore, according to the present invention, there is provided an automatic coating apparatus which includes: a working mechanism be put in a coating action relative to a coating object; a common main assembly body fixedly mounted on the working mechanism to serve as a common main body for a number of sprayers; bell-shape heads each being replaceably connectible to the common main assembly body to form a bell-shape sprayer in combination with the common main assembly body and capable of spraying paint in finely atomized form by means of a bell cup rotating at high speed; and a head changer located within a working area of the working mechanism and provided with head gripping means for gripping the bell-shape heads at the time of replacement. With the arrangements just described, a bell-shape head which is detachably attached to the common main assembly body can be replaced in an efficient manner simply by moving the head to a predetermined replacing position on the head changer by means of the working mechanism.

Further, in preparing a coating apparatus, a bell-shape head which is suited for a particular coating operation can be connected to the common main assembly body. It follows that a coating object can be coated by spraying supplied paint toward the coating object from the bell-shape head while moving the sprayer with the working mechanism. Besides, since the bell-shape head is disconnectibly connected to the common main assembly body, for example, a diversity of bell-shape heads with different spray patterns can be interchangeably connected to the common main assembly body, depending upon the nature of coating surfaces on coating object, making it possible to cope with various coating conditions by the use of one and single common main assembly body. Furthermore, the above arrangements, permitting to share one working mechanism such as a coating robot or the like among a plural number of bell-shape heads, contribute to reduce the number of the working mechanisms as well as the installation space for the automatic coating apparatus and to downsize the coating booth.

What is claimed is:

1. An automatic coating apparatus, comprising:

a working mechanism to be put in predetermined coating actions relative to a coating object;

a common main assembly body fixedly mounted on said working mechanism to serve as a common main assembly body for a number of sprayers;

a number of bell-shape heads each displaceably connectible to said common main assembly body to form bell-shape sprayers and adapted to spray supplied paint in a finely atomized form by means of a bell-shaped cup rotating at high speed; and a head changer provided within a working area of said working mechanism and adapted to hold a grip on and off said bell-shape heads at the time of replacing a bell-shape head on said common main assembly body, wherein said bell-shape heads are each internally provided with an axial feed tube passage hole, and wherein said head changer is provided with washing mechanisms for washing said bell-shape heads while being gripped on said head changer, said washing mechanisms each being provided with a wash fluid supply tube adapted to be inserted into said axial feed tube passage hole in said bell-shape head for spurting a wash fluid thereinto.

2. An automatic coating apparatus as defined in claim 1, wherein said head changer is comprised of at least a couple of head gripper mechanisms, one for gripping a bell-shape head which has been transferred to a predetermined replacing position by said working mechanism, and the other one for holding another bell-shape head in a waiting position in preparation for connection to said common main assembly body.

3. An automatic coating apparatus as defined in claim 1, wherein said head changer is comprised of head gripping mechanisms each adapted to hold a grip on and off a bell-shape head.

4. An automatic coating apparatus as defined in claim 1, wherein said head changer is comprised of at least a couple of head gripping mechanisms, one for gripping a used bell-shape head which has been transferred to a predetermined replacing position by said working mechanism and the other one for holding another washed bell-shape head in a waiting position in preparation for connection to said common main assembly body.

5. An automatic coating apparatus as defined in claim 1, wherein said head changer is comprised of head gripping mechanisms adapted to hold a grip on and off a bell-shape head, and a bearing air supply mechanism adapted to supply air to air bearing of an air motor of a bell-shape head which is gripped on one of said head gripping mechanisms.

6. An automatic coating apparatus as defined in claim 1, wherein each one of said bell-shape sprayers is of a cartridge-type bell-shape sprayer adapted to be replaceably loaded with paint cartridges of various colors, each one of said paint cartridge comprising a container filled with paint and a feed tube extending axially forward from said container.

7. An automatic coating apparatus as defined in claim 6, wherein said common main assembly body comprises a cartridge loading cavity for receiving said paint cartridge and an axial feed tube passage hole to receive said feed tube, and each one of said bell-shape heads is internally provided with axial feed tube passage hole to receive said feed tube.

8. An automatic coating apparatus as defined in claim 6, wherein each one of said bell-shape heads is internally provided with axial feed tube passage hole to receive said feed tube of said paint cartridge therein, and said head changer is provided with head gripping mechanisms for gripping said bell-shape heads.

9. An automatic coating apparatus as defined in claim 6, wherein each axial feed tube passage hole is configured to receive said feed tube of said paint cartridge, and said head changer is provided with head gripping mechanisms for gripping said bell-shape heads, and bearing air supply mechanisms for supplying bearing air to an air bearing of an air motor in said bell-shape heads while being gripped on said gripping mechanisms, said washing mechanisms each being provided with a turbine air supply passage for supplying turbine air to said air motor of a bell-shape head being washed, thereby keeping said bell cup in rotation during a washing operation.

10. An automatic coating apparatus as defined in claim 1, wherein said common main assembly body is provided with a head connecting portion to which one of said bell-shape heads is disconnectibly connected, and an air suction passage in communication with a vacuum space formed between said head connecting portion and a connected bell-shape head, sucking out air from said vacuum space through said air suction passage to hold said bell-shape head fixedly to said common main assembly body with suction grip.

11. An automatic coating apparatus as defined in claim 1, wherein said common main assembly body has a feed tube axially projected on the front side thereof, while said bell-shape heads are each internally provided with axial feed tube passage hole to receive said feed tube.

12. An automatic coating apparatus as defined in claim 1, wherein said working mechanism is a coating robot or a coating reciprocator provided in a coating booth, and said common main assembly body is mounted on a distal end portion of said coating robot or reciprocator.

13. An automatic coating apparatus, comprising:

a working mechanism to be put in predetermined coating actions relative to a coating object;

a common main assembly body fixedly mounted on said working mechanism to serve as a common main assembly body for a number of sprayers;

a number of bell-shape heads each displaceably connectible to said common main assembly body to form bell-shape sprayers and adapted to spray supplied paint in a finely atomized form by means of a bell-shaped cup rotating at high speed;

a number of paint cartridges of different colors, each having a container filled with a specific paint color, a feed tube axially extending out on the front side of said container for insertion into said common main assembly body and one of said bell-shape heads; and a head changer provided with in a working area of said working mechanism and adapted to hold a grip on and off said bell-shape heads at the time of replacing a bell-shape head on said common main assembly body, wherein said bell-shape sprayers are formed the cartridge-type bell-shape sprayers which are replacably connected a number of paint cartridge of different colors to said common main assembly body, wherein said bell-shape heads are each internally provided with an axial feed tube passage hole, and wherein said head changer is provided with washing mechanisms for washing said bell-shape heads while being gripped on said head changer, said washing mechanisms each being provided with a wash fluid supply tube adapted to be inserted into said axial feed tube passage hole in said bell-shape head for spurting a wash fluid thereinto.

* * * * *